US010126668B2

(12) United States Patent
Sugama et al.

(10) Patent No.: US 10,126,668 B2
(45) Date of Patent: Nov. 13, 2018

(54) TONER FOR ELECTROSTATIC CHARGE IMAGE DEVELOPMENT

(71) Applicant: Konica Minolta, Inc., Tokyo (JP)

(72) Inventors: Kouji Sugama, Musashino (JP); Shiro Hirano, Hachioji (JP); Noboru Ueda, Mitaka (JP); Kaori Matsushima, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/692,661

(22) Filed: Aug. 31, 2017

(65) Prior Publication Data

US 2018/0081288 A1 Mar. 22, 2018

(30) Foreign Application Priority Data

Sep. 21, 2016 (JP) ..... 2016-184774

(51) Int. Cl.
*G03G 9/087* (2006.01)

(52) U.S. Cl.
CPC ..... *G03G 9/08755* (2013.01); *G03G 9/08711* (2013.01); *G03G 9/08728* (2013.01); *G03G 9/08782* (2013.01); *G03G 9/08795* (2013.01); *G03G 9/08797* (2013.01)

(58) Field of Classification Search
CPC ..... G03G 9/08724; G03G 9/087
See application file for complete search history.

(56) References Cited

U.S. PATENT DOCUMENTS

2015/0220009 A1 8/2015 Sato et al.
2016/0048090 A1* 2/2016 Masuda ..... G03G 9/081 430/108.4
2017/0010553 A1* 1/2017 Veregin ..... G03G 9/09364

FOREIGN PATENT DOCUMENTS

JP 2015148724 A 8/2015

* cited by examiner

*Primary Examiner* — Hoa V Le
(74) *Attorney, Agent, or Firm* — Lucas & Mercanti, LLP

(57) ABSTRACT

A toner for electrostatic charge image development contains a binder resin and a releasing agent. The binder resin contains an amorphous polyester resin as a main component and a vinyl resin, the vinyl resin contains a constitutional unit derived from a specific monomer. The releasing agent has a melting point of from 65 to 90° C. and contains an ester wax.

14 Claims, No Drawings

TONER FOR ELECTROSTATIC CHARGE IMAGE DEVELOPMENT

CROSS-REFERENCE TO RELATED APPLICATION

This application is based on Japanese Patent Application No. 2016-184774 filed on Sep. 21, 2016, the contents of which are incorporated herein by reference.

BACKGROUND

1. Technological Field

The present invention relates to a toner for electrostatic charge image development.

2. Description of the Related Art

In recent years, from the viewpoint of high speed and energy saving, a toner exhibiting excellent low temperature fixability is demanded in order to fix a toner image with less energy than before. It is required to lower the melting temperature and melt viscosity of the binder resin forming the toner in order to lower the fixing temperature of the toner.

A toner containing a polyester resin as a main component of the binder resin has been proposed in order to fix the toner at a low temperature. A polyester resin is advantageous from the viewpoint of securing low temperature fixability of the toner since it has a property of having a relatively low softening point. On the other hand, a technique capable of improving not only the low temperature fixability but also other properties is demanded in association with recent demands for diversification of printed matter and improvement in image quality. In this regard, there is a problem that hot offset and the like, in which excessively melted toner particles generated at a fixing nip portion migrate to a fixing member, are likely to occur in the case of a toner containing a polyester resin as a main component of the binder resin as described above. Hence, in JP-A-2015-148724 (corresponding to US 2015/220009 A1), a technique containing styrene (meth)acrylic resin particles (vinyl resin particles) and a hydrocarbon-based wax in addition to a binder resin containing a polyester resin is proposed as a technique capable of improving hot offset resistance and the like.

SUMMARY

However, in the technique according to JP-A-2015-148724 (corresponding to US 2015/220009 A1), there is a problem that the image quality decreases as image noise (fog) occurs and set-off of toner occurs as the document offset resistance is not sufficiently secured.

Accordingly, an object of the present invention is to provide a means for suppressing the occurrence of image noise (fog) and improving the document offset resistance while maintaining sufficient low temperature fixability and hot offset resistance in a toner for electrostatic charge image development.

In view of the above problems, the present inventors have conducted intensive studies and found out that the above object can be achieved by the following configuration. To achieve at least one of the abovementioned objects, a toner for electrostatic charge image development that reflects one aspect of the present invention has the following configuration.

A toner for electrostatic charge image development including: a binder resin and a releasing agent, wherein the binder resin contains an amorphous polyester resin as a main component and a vinyl resin, wherein the vinyl resin contains a constitutional unit derived from a monomer represented by the following General Formula (1), and the releasing agent has a melting point of from 65 to 90° C. and contains an ester wax:

General Formula (1)

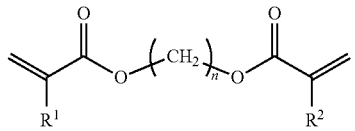

in the General Formula (1), $R^1$ and $R^2$ each independently represent a hydrogen atom or a methyl group and n is an integer from 8 to 30.

DETAILED DESCRIPTION OF EMBODIMENTS

Hereinafter, one or more embodiments of the present invention will be described. However, the scope of the invention is not limited to the disclosed embodiments.

The toner for electrostatic charge image development according to the present invention contains a binder resin and a releasing agent and the binder resin contains an amorphous polyester resin as a main component and a vinyl resin. The vinyl resin contains a constitutional unit derived from a monomer represented by the General Formula (1), and the releasing agent has a melting point of from 65 to 90° C. and contains an ester wax.

The toner according to the present invention can suppress the occurrence of image noise (fog) and improve the document offset resistance while maintaining sufficient low temperature fixability and hot offset resistance as it contains the respective components described above. Although the mechanism to obtain the above effect by the toner of the present invention is not clear, it is considered as follows.

The amorphous polyester resin contained in the toner according to the present invention has a property to lower the softening point of the toner while maintaining the relatively high glass transition temperature (Tg). Hence, the toner according to the present invention is easily melted by heat and the low temperature fixability thereof is favorably maintained since the binder resin thereof contains the amorphous polyester resin as a main component.

In addition, the vinyl resin contained in the binder resin together with the amorphous polyester resin has higher elasticity and has a property that the elasticity hardly decreases even at a high temperature, compared to the polyester resin. In particular, the vinyl resin according to the present invention is crosslinked by the monomer represented by General Formula (1), and the elasticity thereof is thus further enhanced. Hence, excessive plasticization of the binder resin is suppressed at the time of thermal fixing of the toner according to the present invention and sufficient hot offset resistance is thus obtained as the binder resin further contains such a vinyl resin. In addition, there is also an advantage that the effect of improving the hot offset resistance by the vinyl resin is not impaired without impairing the effect of improving the low temperature fixability by the amorphous polyester resin, since the vinyl resin exhibits low compatibility with the amorphous polyester resin.

In addition, the present inventors have focused on the kind of wax in the course of studies for suppressing the occurrence of image noise (fog). As a result, it has been found out that the occurrence of image noise is suppressed by using an ester wax.

In general, both an ester wax and a hydrocarbon-based wax tend to decrease the chargeability of the toner by being exposed on the surface of the toner particles. A hydrocarbon-based wax is used as a releasing agent together with a binder resin containing a polyester resin in the technique disclosed in JP-A-2015-148724 (corresponding to US 2015/220009 A1). However, the hydrocarbon-based wax has relatively low polarity and the affinity thereof for a highly polar polyester resin is thus low. Hence, it is assumed that the image noise (fog) and a decrease in image quality would be occurred since the hydrocarbon-based wax is likely to be exposed on the surface of the toner particles and causes charging failure of the toner particles and contamination of the photoreceptor.

On the other hand, the toner according to the present invention contains an ester wax as a releasing agent. The ester wax has higher affinity for the amorphous polyester resin than the hydrocarbon-based wax. Further, the vinyl resin contained together with the amorphous polyester resin has higher affinity for the ester wax. In addition, the vinyl resin to be used in the present invention contains a constitutional unit derived from the monomer (simply referred to as the "crosslinking agent" in some cases in the present specification) which is represented by the General Formula (1). The monomer has an ester group derived from a (meth)acrylate group and a linear alkylene group having an appropriate length ($—(CH_2)_n—$; n=an integer from 8 to 30). Accordingly, the affinities of the ester wax for the ester group and the linear alkylene group having an appropriate length which are present in the vinyl resin is enhanced, and the affinity of the ester wax for the vinyl resin is thus further improved. As a result, the exposure of the ester wax onto the surface of toner particles is suppressed and the effect of suppressing image noise (fog) is improved.

As described above, according to the toner of the present invention, the effect of suppressing image noise (fog) can be obtained as the exposure of releasing agent (ester wax) onto the surface of toner particles is suppressed while the low temperature fixability by the amorphous polyester resin is maintained. On the other hand, in a case in which the releasing agent is involved in the toner particles, the releasing agent hardly oozes out to the image surface at the time of thermal fixing, the image is hardly peeled off when the fixed images are stacked, and set-off of the toner occurs in some cases.

The present inventors have further conducted studies on such a problem and found out that favorable document offset resistance can be obtained by using a releasing agent having a melting point of from 65 to 90° C. The reason for this is considered to be that the releasing agent is likely to ooze out to the image surface at the time of thermal fixing by using a releasing agent having a melting point in an appropriate range.

As described above, in the toner for electrostatic charge image development according to the present invention, the binder resin contains an amorphous polyester resin as a main component and a vinyl resin and the vinyl resin contains a constitutional unit derived from a specific bifunctional (meth)acrylic acid ester monomer. In addition, the toner for electrostatic charge image development according to the present invention further contains a releasing agent having a melting point in a specific range, and the releasing agent contains an ester wax. According to the toner for electrostatic charge image development of the present invention, by containing these components, a means for suppressing the occurrence of image noise (fog) and improving the document offset resistance while maintaining sufficient low temperature fixability and hot offset resistance is provided.

Incidentally, the mechanism described above is based on presumption, and the present invention is not limited to the mechanism described above at all.

Hereinafter, embodiments of the present invention will be described. Incidentally, the present invention is not limited to only the following embodiments. In addition, the term "X to Y" indicating the range includes X and Y and means "X or more and Y or less" in the present specification. In addition, the operations and the measurements of physical properties are conducted under the conditions of room temperature (20 to 25° C.) and a relative humidity of from 40% RH to 50% RH unless otherwise stated.

<Toner for Electrostatic Charge Image Development>

The toner for electrostatic charge image development of the present invention (simply referred to as the "toner" in some cases in the present specification) contains a binder resin containing a vinyl resin and an amorphous polyester resin as a main component and a specific releasing agent.

[Binder Resin]

The binder resin contained in the toner (toner particles) according to the present invention contains an amorphous polyester resin as a main component and a vinyl resin.

<<Amorphous Polyester Resin>>

The amorphous polyester resin is a main component of the binder resin to be contained in the toner. Here, the "main component" means the resin having the highest contained proportion in the binder resin to be contained in the toner. The amorphous polyester resin is preferably from 50 to 96% by mass, more preferably from 55 to 90% by mass, particularly preferably from 60 to 85% by mass, and most preferably from 70 to 85% by mass relative to the total mass of the binder resin.

The amorphous polyester resin is a polyester resin and a resin which does not have a melting point but has a relatively high glass transition temperature (Tg) when being subjected to differential scanning calorimetry (DSC). At this time, the glass transition temperature (Tg) is preferably from 30 to 80° C. and particularly preferably from 40 to 64° C. Incidentally, the glass transition temperature (Tg) can be measured by using a differential scanning calorimeter (DSC), and specifically it is measured by the method described in Examples. In addition, the monomer forming the amorphous polyester resin is different from the monomer forming the crystalline polyester resin. Therefore, an amorphous polyester resin can be distinguished from a crystalline polyester resin, for example, by analysis such as NMR. Furthermore, the glass transition temperature can be controlled by the composition of the resin by those skilled in the art.

The amorphous polyester resin is obtained by a polycondensation reaction of a di- or higher carboxylic acid (polycarboxylic acid) with a dihydric or higher alcohol (polyhydric alcohol). The amorphous polyester resin is not particularly limited, and an amorphous polyester resin conventionally known in the present technical field can be used.

The polycarboxylic acid and polyhydric alcohol to be used in preparation of the amorphous polyester resin are not particularly limited, but examples thereof may include the following ones.

(Polycarboxylic Acid)

As the polycarboxylic acid, it is preferable to use an unsaturated aliphatic polycarboxylic acid, an aromatic polycarboxylic acid, and any derivative thereof. A saturated aliphatic polycarboxylic acid may be concurrently used as long as an amorphous resin can be formed.

Examples of the unsaturated aliphatic polycarboxylic acid may include an unsaturated aliphatic dicarboxylic acid such as methylenesuccinic acid, fumaric acid, maleic acid, 3-hexenedioic acid, 3-octenedioic acid, or succinic acid substituted with an alkenyl group having from 2 to 20 carbon atoms; an unsaturated aliphatic tricarboxylic acid such as 3-butene-1,2,3-tricarboxylic acid, 4-pentene-1,2,4-tricarboxylic acid, or aconitic acid; and an unsaturated aliphatic tetracarboxylic acid such as 4-pentene-1,2,3,4-tetracarboxylic acid, and any lower alkyl ester and acid anhydride thereof can also be used.

Examples of the aromatic polycarboxylic acid may include an aromatic dicarboxylic acid such as phthalic acid, terephthalic acid, isophthalic acid, t-butylisophthalic acid, tetrachlorophthalic acid, chlorophthalic acid, nitrophthalic acid, p-phenylenediacetic acid, 2,6-naphthalenedicarboxylic acid, 4,4'-biphenyldicarboxylic acid, or anthracenedicarboxylic acid; an aromatic tricarboxylic acid such as 1,2,4-benzenetricarboxylic acid (trimellitic acid), 1,2,5-benzenetricarboxylic acid (trimesic acid), 1,2,4-naphthalenetricarboxylic acid, or hemimellitic acid; an aromatic tetracarboxylic acid such as pyromellitic acid; and an aromatic hexacarboxylic acid such as mellitic acid, and any lower alkyl ester and acid anhydride thereof can also be used.

The polycarboxylic acids described above may be used singly or in mixture of two or more kinds thereof.

(Polyhydric Alcohol)

From the viewpoint of chargeability and toner strength, it is preferable to use an unsaturated aliphatic polyhydric alcohol, an aromatic polyhydric alcohol, and any derivative thereof as the polyhydric alcohol. A saturated aliphatic polyhydric alcohol may be concurrently used as long as an amorphous resin can be formed.

Examples of the unsaturated aliphatic polyhydric alcohol may include an unsaturated aliphatic diol such as 2-butene-1,4-diol, 3-butene-1,4-diol, 2-butyne-1,4-diol, 3-butyne-1,4-diol, or 9-octadecene-7,12-diol, and any derivative thereof can also be used.

Examples of the aromatic polyhydric alcohol may include a bisphenol such as bisphenol A or bisphenol F and an alkylene oxide adduct of a bisphenol such as an ethylene oxide adduct or propylene oxide adduct thereof, 1,3,5-benzenetriol, 1,2,4-benzenetriol, and 1,3,5-trihydroxymethylbenzene, and any derivative thereof can also be used. Among these, it is preferable to use a bisphenol A compound such as an ethylene oxide adduct or propylene oxide adduct of bisphenol A particularly from the viewpoint of being able to easily optimize the thermal properties.

In addition, the number of carbon atoms in the trihydric or higher polyhydric alcohol is not particularly limited, but the number of carbon atoms is preferably from 3 to 20 since the thermal properties can be easily optimized in particular.

The polyhydric alcohols described above may be used singly or in mixture of two or more kinds thereof.

The method of producing the amorphous polyester resin is not particularly limited, and it is possible to produce the resin by polycondensation (esterification) of the polycarboxylic acid with the polyhydric alcohol using a known esterification catalyst.

Examples of the catalyst usable in the production may include a compound of an alkali metal such as sodium or lithium; a compound containing a Group 2 element such as magnesium or calcium; a compound of a metal such as aluminum, zinc, manganese, antimony, titanium, tin, zirconium, or germanium; a phosphorous acid compound; a phosphoric acid compound; and an amine compound. It is preferable to use dibutyltin oxide, tin octylate, tin dioctylate, any salt thereof, tetra-n-butyl titanate (tetrabutyl orthotitanate), tetraisopropyl titanate (titanium tetraisopropoxide), and tetramethyl titanate in consideration of availability and the like. These may be used singly or in combination of two or more kinds thereof.

The temperature for the polycondensation (esterification) is not particularly limited, but it is preferably from 150 to 250° C. In addition, the time for the polycondensation (esterification) is not particularly limited, but it is preferably from 0.5 to 15 hours. The pressure in the reaction system may be decreased during the polycondensation if necessary.

The weight average molecular weight (Mw) of the amorphous polyester resin is not particularly limited, but it is preferably in a range of from 5,000 to 100,000 and more preferably in a range of from 5,000 to 50,000. It is possible to improve the heat resistant storage property of the toner when the weight average molecular weight (Mw) is 5,000 or more, and it is possible to further improve the low temperature fixability when the weight average molecular weight (Mw) is 100,000 or less. In addition, the number average molecular weight (Mn) of the resin is not particularly limited, but it is preferably in a range of from 1,500 to 25,000. The weight average molecular weight (Mw) and the number average molecular weight (Mn) can be measured by gel permeation chromatography (GPC), and specifically by the methods described in Examples.

Furthermore, it is preferable that the amorphous polyester resin has an acid value of from 5 to 50 mg KOH/g. By setting the acid value of the amorphous polyester resin to be in such a range, the amorphous polyester resin, the vinyl resin, and the ester wax are likely to be uniformly dispersed. Accordingly, the ester wax is hardly exposed on the surface of the toner particles and the occurrence of image noise (fog) is thus suppressed. Incidentally, the acid value of the amorphous polyester resin can be measured by the method described in Examples.

<<Vinyl Resin>>

The binder resin contains a vinyl resin together with the amorphous polyester resin described above. The vinyl resin according to the present invention is a polymer having a constitutional unit derived from a monomer (crosslinking agent) represented by the following General Formula (1).

General Formula (1)

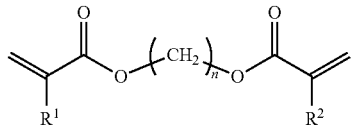

In General Formula (1) above, $R^1$ and $R^2$ each independently represent a hydrogen atom or a methyl group and n is an integer from 8 to 30.

A vinyl resin generally has higher affinity for an ester wax compared to an amorphous polyester resin. In addition, the vinyl resin to be used in the toner of the present invention has even higher affinity for an ester wax since the constitutional unit derived from the (meth)acrylate group contained at the end of the General Formula (1) has a structural similarity with the ester group contained in the ester wax. Furthermore, the monomer represented by the General Formula (1) contains a linear alkylene group having an appropriate chain length. Accordingly, the affinity between the ester wax containing a linear alkylene group and the vinyl resin is further enhanced due to the structural similarity therebetween.

Hence, the amorphous polyester resin and the vinyl resin can be uniformly finely dispersed in the toner of the present invention and the ester wax can form domains in the vicinity of the vinyl resin. As a result, exposure of the ester wax onto the surface of the toner particles is suppressed, the charging failure and the contamination of photoconductor can be reduced, and the occurrence of image noise (fog) can be suppressed.

In addition, by containing a constitutional unit derived from the monomer represented by the General Formula (1), it is also possible to achieve an increase in elasticity of the toner due to the crosslinked structure. Hence, the toner of the present invention can suppress hot offset while maintaining low temperature fixability.

Examples of the monomer represented by the General Formula (1) may include 1,8-octanediol di(meth)acrylate, 1,9-nonanediol di(meth)acrylate, 1,10-decanediol di(meth) acrylate, 1,11-undecanediol di(meth)acrylate, 1,12-dodecanediol di(meth)acrylate, 1,13-tridecanediol di(meth)acrylate, 1,14-tetradecanediol di(meth)acrylate, 1,15-pentadecanediol di(meth)acrylate, 1,16-hexadecanediol di(meth)acrylate, 1,17-heptadecanediol di(meth)acrylate, 1,18-octadecanediol di(meth)acrylate, 1,19-nonadecanediol di(meth)acrylate, 1,20-eicosanediol di(meth)acrylate, 1,21-heneicosanediol di(meth)acrylate, 1,22-docosanediol di(meth)acrylate, 1,23-tricosanediol di(meth)acrylate, 1,24-tetracosanediol di(meth)acrylate, 1,25-pentacosanediol di(meth) acrylate, 1,26-hexacosanediol di(meth)acrylate, 1,27-heptacosanediol di(meth)acrylate, 1,28-octacosanediol di(meth)acrylate, 1,29-nonacosanediol di(meth)acrylate, and 1,30-triacontanediol di(meth)acrylate. These may be used singly or in combination of two or more kinds thereof. Incidentally, the term "(meth)acrylate" means an "acrylate and/or a methacrylate" in the present specification.

n in the General Formula (1) is an integer from 8 to 30. In a case in which n is smaller than 8, the affinity between the ester wax and the vinyl resin cannot be sufficiently obtained, thus the ester wax is likely to be exposed on the surface of the toner particles and image noise (fog) is likely to occur. On the other hand, in a case in which n is greater than 30, the effect due to the affinity between the constitutional unit derived from the (meth)acrylate group in the General Formula (1) and the ester group in the ester wax cannot be sufficiently obtained and the affinity between the ester wax and the vinyl resin thus decreases. Hence, image noise (fog) is likely to occur. In addition, when n is greater than 30, the affinity of the vinyl resin for the highly polar amorphous polyester resin decreases and the dispersibility of the vinyl resin in the binder resin decreases since the polarity of the vinyl resin decreases. Hence, the elasticity of the toner is insufficiently enhanced and the hot offset resistance decreases.

Among the monomers represented by the General Formula (1), monomers in which n is an integer from 10 to 25 are preferable, monomers in which n is an integer from 10 to 18 are more preferable, and monomers in which n is an integer from 10 to 15 are particularly preferable. In other words, it is particularly preferable that the vinyl resin contains a constitutional unit derived from at least one selected from the group consisting of 1,10-decanediol di(meth)acrylate, 1,11-undecanediol di(meth)acrylate, 1,12-dodecanediol di(meth)acrylate, 1,13-tridecanediol di(meth) acrylate, 1,14-tetradecanediol di(meth)acrylate, and 1,15-pentadecanediol di(meth)acrylate. By preparing the vinyl resin by using such a monomer, it is possible to even further improve the hot offset resistance and the effect of suppressing the occurrence of image noise (fog).

The vinyl resin having a constitutional unit derived from the monomer represented by the General Formula (1) is a resin obtained by polymerizing at least the monomer represented by the General Formula (1). The vinyl resin may be obtained by further using other vinyl monomers in addition to the monomer represented by the General Formula (1). At this time, the amount of the monomer represented by the General Formula (1) is preferably from 0.05 to 10.0% by mass, more preferably from 0.1 to 5.0% by mass, particularly preferably from 0.2 to 3.0% by mass, and most preferably from 0.3 to 2.0% by mass relative to the total amount of the monomers constituting the vinyl resin. In other words, the amount of the constitutional unit derived from the monomer represented by the General Formula (1) is preferably from 0.05 to 10.0% by mass, more preferably from 0.1 to 5.0% by mass, particularly preferably from 0.2 to 3.0% by mass, and most preferably from 0.3 to 2.0% by mass relative to all of the constitutional units of the vinyl resin. By setting the contained proportion of the constitutional unit derived from the monomer represented by the General Formula (1) to be in the above range, the low temperature fixability and the hot offset resistance are improved, and at the same time, the effect of suppressing the occurrence of image noise (fog) and document offset is improved. Incidentally, the amounts (proportions) of the constitutional components (constitutional units) of the vinyl resin and the respective constitutional components (constitutional units) can be specified by NMR measurement and methylation reaction Py-GC/MS measurement.

(Other Vinyl Monomers)

In the formation of the vinyl resin, one kind or two or more kinds selected from the following monomers can be used in addition to the monomer represented by the General Formula (1).

(1) Styrene Monomer

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and any derivative thereof.

(2) (Meth)acrylic Acid Ester Monomer

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, n-stearyl (meth)acrylate, lauryl (meth)acrylate, phenyl (meth)acrylate, diethylaminoethyl (meth)acrylate, dimethylaminoethyl (meth)acrylate, and any derivative thereof.

The vinyl resin may be formed by further using the following monomers in addition to the monomers described above.

(3) Vinyl Esters

Vinyl propionate, vinyl acetate, vinyl benzoate, and the like;

(4) Vinyl Ethers

Vinyl methyl ether, vinyl ethyl ether, and the like;

(5) Vinyl Ketones

Vinyl methyl ketone, vinyl ethyl ketone, vinyl hexyl ketone, and the like;

(6) N-vinyl Compounds

N-vinylcarbazole, N-vinylindole, N-vinylpyrrolidone, and the like; and (7) Other Monomers Vinyl compounds such as vinyl naphthalene and vinyl pyridine, derivatives of acrylic acid or methacrylic acid such as acrylonitrile, methacrylonitrile, and acrylamide, and the like.

In addition, it is preferable to use a vinyl monomer having an ionically dissociable group such as a carboxyl group, a sulfonic acid group, or a phosphoric acid group as a monomer. Specifically, there are the following monomers.

Examples of the monomer having a carboxyl group may include acrylic acid, methacrylic acid, maleic acid, itaconic acid, cinnamic acid, fumaric acid, a monoalkyl ester of maleic acid, and a monoalkyl ester of itaconic acid. In addition, examples of the monomer having a sulfonic acid group may include styrenesulfonic acid, allylsulfosuccinic acid, and 2-acrylamide-2-methylpropanesulfonic acid. Furthermore, examples of the monomer having a phosphoric acid group may include acidophosphoxyethyl methacrylate.

Among them, the monomers described in "(1) Styrene Monomer" and/or "(2) (Meth)acrylic Acid Ester Monomer" above are preferably used as the "(Other Vinyl Monomers)" (monomers constituting the vinyl resin other than the monomer represented by the General Formula (1)). In other words, an acrylic resin and a styrene-acrylic copolymer resin are preferable as the vinyl resin.

The method of producing the vinyl resin is not particularly limited, and examples thereof may include a method in which polymerization is conducted by using an arbitrary polymerization initiator, such as a peroxide, a persulfide, a persulfate, or an azo compound, which is usually used in polymerization of the monomers described above and a known polymerization technique such as bulk polymerization, solution polymerization, an emulsion polymerization method, a mini-emulsion method, or a dispersion polymerization method. In addition, a known chain transfer agent can be used for the purpose of adjusting the molecular weight. Examples of the chain transfer agent may include an alkyl mercaptan such as n-octyl mercaptan, and a mercapto fatty acid ester.

The vinyl resin is preferably an amorphous resin having a glass transition temperature (Tg) of from 25 to 70° C. and more preferably an amorphous resin having a glass transition temperature (Tg) of from 35 to 65° C. Incidentally, the glass transition temperature (Tg) of the vinyl resin can be measured by the method described in Examples.

In addition, the elasticity at a high temperature increases as the molecular weight of the vinyl resin measured by gel permeation chromatography (GPC) increases, and the hot offset can be thus effectively suppressed. Specifically, the molecular weight of the vinyl resin is preferably from 10,000 to 300,000, more preferably from 30,000 to 200,000, and particularly preferably from 50,000 to 150,000 as the weight average molecular weight (Mw). By setting the molecular weight to be in the above range, it is possible to improve the hot offset resistance while maintaining the low temperature fixability. In addition, the number average molecular weight (Mn) of the vinyl resin is preferably from 5,000 to 100,000, more preferably from 9,000 to 55,000, and particularly preferably from 15,000 to 30,000 from the same viewpoint. Incidentally, the molecular weight (weight average molecular weight and number average molecular weight) of the vinyl resin can be measured by the method described in Examples.

The amount of the vinyl resin in the binder resin is preferably from 3 to 40% by mass, more preferably from 3 to 20% by mass, particularly preferably from 5 to 15% by mass from the viewpoint of improving the effect of suppressing the occurrence of image noise (fog) and document offset while favorably maintaining the low temperature fixability and hot offset resistance.

The acid value of the vinyl resin is preferably from 0.1 to 50 mg KOH/g, more preferably from 1 to 30 mg KOH/g, and particularly preferably from 5 to 20 mg KOH/g. The affinity between the amorphous polyester resin and the vinyl resin is improved as the acid value of the vinyl resin increases, and thus it is difficult for the vinyl resin to form a large domain and the vinyl resin is uniformly finely dispersed. On the other hand, the hydrophilicity of the vinyl resin relatively decreases as the acid value of the vinyl resin decreases, and the highly hydrophobic ester wax is likely to be present in the vicinity of the vinyl resin. Due to the above reasons, the vinyl resin is finely dispersed and the ester wax is likely to be present in the vicinity of the vinyl resin by setting the acid value of the vinyl resin to be in the above range. As a result, the hot offset resistance is improved, exposure of the ester wax is suppressed, and the occurrence of image noise (fog) is suppressed.

Incidentally, the acid value of the vinyl resin can be measured by the method described in Examples. In addition, the acid value can be arbitrarily adjusted by a technique to introduce an acidic group such as a carboxyl group or a sulfo group into the end of the main chain of the molecular structure and the like.

<<Other Resins>>

In the toner of the present invention, the binder resin may contain resins other than the amorphous polyester resin and vinyl resin described above. Among them, the binder resin to be contained in the toner of the present invention preferably contains a crystalline resin. By containing a crystalline resin, the amorphous polyester resin and the crystalline resin are compatible with each other at the time of thermal fixing, and it is thus possible to improve the low temperature fixability. Accordingly, the toner according to the present invention can obtain favorable low temperature fixability even in a high-speed process (for example, a full-color high-speed process with a linear velocity of from 400 to 650 mm/s).

The crystalline resin is not particularly limited as long as it is a resin having crystallinity, and a crystalline resin conventionally known in the present technical field can be used. Specific examples thereof may include a crystalline polyester resin, a crystalline polyurethane resin, a crystalline polyurea resin, a crystalline polyamide resin, and a crystalline polyether resin. The crystalline resin may be used singly or in combination of two or more kinds thereof.

Among them, the crystalline resin preferably contains a crystalline polyester resin. The crystalline polyester resin has favorable affinity for the amorphous polyester resin described above, thus the crystalline polyester resin exhibits favorable dispersibility in the toner and it is also possible to further improve the sharp meltability at the time of fixing so that the low temperature fixability becomes more favorable.

The crystalline polyester resin is a polyester resin and refers to a resin which does not have a stepwise endothermic change but has a clear endothermic peak in the differential scanning calorimetry (DSC). Specifically, the clear endothermic peak means a peak of which the full width at half maximum of the endothermic peak is 15° C. or less when measured at 10° C./min of a temperature increase rate in measurement of the differential scanning calorimetry (DSC).

The melting point (Tc) of the crystalline resin is preferably from 55 to 90° C. and more preferably from 70 to 88° C. Sufficient low temperature fixability is obtained when the melting point of the crystalline resin is in the above range. The melting point (Tc) of the crystalline resin can be measured by using a differential scanning calorimeter (DSC), and specifically it is measured by the method described in Examples. In addition, the melting point can be controlled by the composition of the resin by those skilled in the art.

The crystalline polyester resin is obtained by the polycondensation reaction of a di- or higher carboxylic acid (polycarboxylic acid) with a dihydric or higher alcohol (polyhydric alcohol). The crystalline polyester resin is not particularly limited, and a crystalline polyester resin conventionally known in the present technical field can be used.

The polycarboxylic acid and polyhydric alcohol to be used in the formation of the crystalline polyester resin are not particularly limited, but examples thereof may include the following monomers.

(Polycarboxylic Acid)

Examples of the polycarboxylic acid may include a saturated aliphatic dicarboxylic acid such as oxalic acid, malonic acid, succinic acid, adipic acid, pimelic acid, sebacic acid, azelaic acid, n-dodecylsuccinic acid, 1,9-nonanedicarboxylic acid, 1,10-decanedicarboxylic acid (dodecanedioic acid), 1,11-undecanedicarboxylic acid, 1,12-dodecanedicarboxylic acid, 1,13-tridecanedicarboxylic acid, or 1,14-tetradecanedicarboxylic acid; and an alicyclic dicarboxylic acid such as cyclohexanedicarboxylic acid. In addition, a polycarboxylic acid other than a dicarboxylic acid may also be used. Furthermore, any lower alkyl ester and acid anhydride thereof can also be used. These polycarboxylic acids may be used singly or in mixture of two or more kinds thereof.

(Polyhydric Alcohol)

Examples of the polyhydric alcohol may include an aliphatic diol such as ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, neopentyl glycol, or 1,4-butenediol. In addition, examples of polyols other than a dihydric alcohol may include a trihydric or higher polyhydric alcohol such as glycerin, pentaerythritol, trimethylolpropane, or sorbitol. In addition, any derivative thereof may also be used. The polyhydric alcohols may be used singly or in combination of two or more kinds thereof.

In addition, the polycarboxylic acid and polyhydric alcohol may be partially branched or crosslinked depending on the selection of the valence of the polycarboxylic acid and the valence of the polyhydric alcohol.

The method of forming the crystalline polyester resin using the above monomer is not particularly limited, and the resin can be formed by polycondensation (esterification) of the polycarboxylic acid with the polyhydric alcohol using a known esterification catalyst. Specifically, the catalyst and polycondensation conditions described in the section of <<Amorphous Polyester Resin>> above can be applied.

The number average molecular weight (Mn) of the crystalline resin (preferably crystalline polyester resin) is not particularly limited, but it is preferably in a range of from 1,500 to 30,000 and more preferably in a range of from 3,000 to 25,000. In addition, the weight average molecular weight (Mw) of the crystalline resin (preferably crystalline polyester resin) is not particularly limited, but it is preferably in a range of from 5,000 to 100,000 and more preferably in a range of from 10,000 to 50,000. The low temperature fixability can be further improved when the molecular weight (Mw or Mn) of the crystalline resin is in the above ranges. The number average molecular weight (Mn) and the weight average molecular weight (Mw) can be measured by gel permeation chromatography (GPC), and specifically, by the methods described in Examples.

The amount of the crystalline resin (preferably crystalline polyester resin) in the binder resin is preferably from 1 to 30% by mass, more preferably from 3 to 25% by mass, particularly preferably from 5 to 15% by mass. A toner having low temperature fixability, heat resistance, and chargeability in an excellently balanced manner can be obtained when the amount of the crystalline resin is in the above range.

Furthermore, it is preferable that the crystalline resin (preferably crystalline polyester resin) has an acid value of from 5 to 50 mg KOH/g. By setting the acid value to be in such a range, the crystalline resin is likely to be uniformly dispersed in the amorphous polyester resin and the vinyl resin. Accordingly, low temperature fixability is further improved.

Incidentally, the acid value of the crystalline resin (preferably crystalline polyester resin) can be measured by the method described in Examples.

[Releasing Agent]

The toner of the present invention contains a releasing agent having a melting point of from 65 to 90° C. As described above, a releasing agent having an appropriate melting point easily oozes out to the surface of the fixed image at the time of thermal fixing. Accordingly, the releasing agent buried in the toner particles easily oozes out at the time of thermal fixing, and excellent document offset resistance is thus obtained as well.

It is not preferable that the melting point of the releasing agent is lower than 65° C. from a practical point of view since a part of the releasing agent melts and oozes out to the surface of the toner particles to cause image noise when the toner is stored, the toner is in a state of being loaded in the image forming apparatus, and the like. In addition, the releasing agent cannot be sufficiently crystallized on the image surface but is in a molten state to deteriorate the document offset resistance when the melting point of the releasing agent is low. On the other hand, when the melting point of the releasing agent is higher than 90° C., the releasing agent insufficiently melts and hardly oozes out to the image surface at the time of thermal fixing to decrease the document offset resistance. In addition, when the melting point of the releasing agent is high, the low temperature fixability also decreases.

The melting point of the releasing agent is preferably from 70 to 80° C. particularly from the viewpoint of improving the low temperature fixability and document offset resistance in a well-balanced manner. In addition, when the melting point of the releasing agent is in this range, the releasing agent sufficiently oozes out to the image surface even in a high-speed process, thus excellent fixability and separability are obtained and fine roughness of the image surface is suppressed. Hence, excellent document offset resistance can be obtained and setoff of the toner can be suppressed. Incidentally, the melting point of the releasing agent can be measured by differential scanning calorimetry (DSC), and specifically by the method described in Examples.

In addition, the releasing agent to be contained in the toner of the present invention contains an ester wax. The ester wax has high affinity for the vinyl resin and has high dispersibility in the toner particles containing the vinyl resin. Accordingly, the image noise (fog) can be suppressed since the exposure of the ester wax onto the surface of the toner particles is suppressed. The toner according to the present invention exhibits excellent chargeability, can suppress image noise (fog), and also exhibits excellent document offset resistance since the ester wax is not exposed on the surface at the time of charging as described above.

Specific examples of the ester wax to be contained in the releasing agent may include carnauba wax, montan wax, behenyl behenate, stearyl stearate, behenyl stearate, stearyl behenate, butyl stearate, propyl oleate, glyceryl stearate, monoglyceryl distearate, diglyceryl distearate, pentaerythritol tetrabehenate, diethylene glycol monostearate, dipropylene glycol distearate, sorbitan monostearate, cholesteryl stearate, trimethylolpropane tribehenate, pentaerythritol diacetate dibehenate, glycerin tribehenate, tristearyl trimellitate, and distearyl maleate. These ester waxes may be used singly or in mixture of two or more kinds thereof.

Among these, specifically it is preferable that the releasing agent contains at least one selected from the group consisting of behenyl behenate, stearyl stearate, behenyl stearate, stearyl behenate, and pentaerythritol tetrabehenate in consideration of the preferable melting point of the releasing agent.

Among them, the releasing agent preferably contains a monoester wax. The monoester wax has high affinity for the constitutional unit derived from the monomer represented by the General Formula (1) and the affinity thereof for the vinyl resin is thus further improved. As a result, exposure of the ester wax on the surface of the toner particles is suppressed and the effect of suppressing image noise (fog) is enhanced.

Furthermore, the acid value of the releasing agent is preferably 3 mg KOH/g or less, more preferably 1 mg KOH/g or less, and particularly preferably 0.5 mg KOH/g or less.

The polarity of the releasing agent becomes low when the acid value of the releasing agent is lower, thus the affinity of the releasing agent for the amorphous polyester resin decreases and the releasing agent easily oozes out to the image surface at the time of thermal fixing. Accordingly, it is possible to improve the document offset resistance when the acid value of the releasing agent is in the above range. Incidentally, the lower limit of the acid value is not particularly limited, and it is 0 mg KOH/g. In addition, the acid value of the releasing agent can be measured by the method described in Examples.

The amount of the releasing agent is preferably from 3 to 20 parts by mass and more preferably from 5 to 15 parts by mass relative to 100 parts by mass of the binder resin. It is possible to further improve the document offset resistance while maintaining sufficient low temperature fixability when the amount of the releasing agent is in the above range.

Incidentally, the releasing agent according to the present invention may contain another kind of releasing agent (amide-based wax or the like) other than the ester wax. In this case, it is preferable that the releasing agent contains the ester wax as a main component. Here, the "main component" means the component having the highest contained proportion in the releasing agent contained in the toner. The amount of the ester wax in the releasing agent is preferably 50% by mass or more and more preferably 80% by mass or more relative to the total amount of the releasing agent. However, it is preferable that the releasing agent consists of the ester wax from the viewpoint of improving the dispersibility of the vinyl resin, thereby improving the low temperature fixability and the document offset resistance.

[Colorant]

The toner of the present invention may contain a colorant. Carbon black, a magnetic material, a dye, a pigment, and the like can be arbitrarily used as a colorant. Channel black, furnace black, acetylene black, thermal black, lamp black, or the like is used as carbon black. A ferromagnetic metal such as iron, nickel, or cobalt, an alloy containing these metals, a compound of a ferromagnetic metal such as ferrite or magnetite, or the like can be used as a magnetic material.

As the dye, C.I. Solvent Red 1, 49, 52, 58, 63, 111, or 122, C.I. Solvent Yellow 19, 44, 77, 79, 81, 82, 93, 98, 103, 104, 112, or 162, C.I. Solvent Blue 25, 36, 60, 70, 93, or 95, or the like can be used, and any mixture of these can also be used. As the pigment, C.I. Pigment Red 5, 48:1, 48:3, 53:1, 57:1, 81:4, 122, 139, 144, 149, 166, 177, 178, or 222, C.I. Pigment Orange 31 or 43, C.I. Pigment Yellow 14, 17, 74, 93, 94, 138, 155, 180, or 185, C.I. Pigment Green 7, C.I. Pigment Blue 15:3, 15:4, or 60, or the like can be used, and any mixture of these can also be used.

[Charge Control Agent]

The toner of the present invention may contain a charge control agent. As the charge control agent, it is possible to use various kinds of known compounds such as a nigrosine-based dye, a metal salt of naphthenic acid or a higher fatty acid, an alkoxylated amine, a quaternary ammonium salt compound, an azo-based metal complex, and a salicylic acid metal salt.

The amount of the charge control agent to be added is usually from 0.1 to 10 parts by mass and preferably from 0.5 to 5 parts by mass relative to 100 parts by mass of the binder resin.

[Average Circularity of Toner]

The average circularity of the toner of the present invention is preferably from 0.920 to 1.000 and more preferably from 0.940 to 0.995 from the viewpoint of improving the low temperature fixability. Here, the average circularity is a value measured using the "FPIA-2100" (manufactured by Sysmex Corporation).

Specifically, the toner is wetted with an aqueous solution of a surface active agent, subjected to ultrasonic dispersion for 1 minute to be dispersed, and then subjected to the measurement using the "FPIA-2100" at an appropriate concentration to have the HPF detection number of 4000 under the measurement condition of a HPF (high magnification imaging) mode. The circularity is calculated by the following equation.

Circularity=(circumference length of a circle having an equivalent to a projection area of a particle image)/(circumference length of a projection image of a particle)

In addition, the average circularity is an arithmetic mean value obtained by summing up the circularities of the respective particles and dividing the sum by the total number of the particles measured.

[Volume Average Particle Diameter of Toner]

The volume average particle diameter of the toner is preferably from 3 to 10 μm in terms of volume-based median diameter ($D_{50}$). By setting the volume-based median diameter of the toner to be in the above range, it is possible to achieve fine line reproducibility and high image quality of the image and to decrease the consumption of the toner as compared to the case of using a toner having a larger particle diameter. In addition, it is also possible to secure fluidity of the toner. Here, the volume-based median diameter ($D_{50}$) of the toner can be measured and calculated by using, for example, an apparatus prepared by connecting a computer system for data processing to the "MULTISIZER 3 (manufactured by Beckman Coulter, Inc.)".

The volume-based median diameter of the toner can be controlled by the concentration of the aggregating agent, the added amount of the solvent, the fusion time in the aggregation-fusion step at the time of producing the toner and further the composition of the resin components and the like.

[Structure of Toner Particles]

Incidentally, the toner of the present invention may have a single layer structure or a core-shell structure. The core-shell structure may be not only a form in which the shell layer completely covers the core particle but also a form in which the shell layer partly covers the core particle. In addition, it may be a form in which a part of the shell resin forming the shell layer forms a domain or the like in the core particle. Furthermore, it may be a form in which the shell layer has a multilayer structure formed by two or more layers containing resins having different compositions.

In addition, in the toner of the present invention, it is preferable that the releasing agent is in the state of not being exposed on the surface of the toner particles and is present in the vicinity of the surface of the toner particles from the viewpoint of suppressing image noise (fog) and improving document offset resistance. In the toner of the present invention, the releasing agent containing the ester wax is present in the vicinity of the vinyl resin. Hence, it is preferable that the vinyl resin is also present in the vicinity of the surface of the toner particles. In other words, it is preferable that the toner of the present invention contains toner particles having a layered structure composed of at least two or more layers (an inner layer and an outer surface layer) and the outer layer (surface layer) contains a vinyl resin and a releasing agent containing an ester wax. In this aspect, the outer layer may further contain an amorphous polyester resin as a main component. In addition, it is preferable that the domain of the vinyl resin is dispersed in the matrix of the amorphous polyester resin in order to further enhance the effect of the present invention.

[External Additive]

It is preferable to add known particles such as inorganic fine particles and organic fine particles, lubricant, and the like to the surface of the toner according to the present invention as external additives from the viewpoint of improving charging property and fluidity or cleaning property. As the external additive, various ones may be used in combination. Specific examples thereof may include inorganic oxide fine particles such as silica fine particles, alumina fine particles, and titania fine particles, inorganic stearic acid compound fine particles such as aluminum stearate fine particles and zinc stearate fine particles, or inorganic titanic acid compound fine particles such as strontium titanate fine particles and zinc titanate fine particles. In addition, examples of the lubricant may include metal salts of higher fatty acids such as zinc, aluminum, copper, magnesium, calcium, and the like salts of stearic acid, zinc, manganese, iron, copper, magnesium, and the like salts of oleic acid, zinc, copper, magnesium, calcium, and the like salts of palmitic acid, zinc, calcium, and the like salts of linoleic acid, and zinc, calcium, and the like salts of ricinoleic acid. From the viewpoint of heat-resistant storage property and environmental stability, these external additives may be subjected to a surface treatment using a silane coupling agent, a titanium coupling agent, higher fatty acid, silicone oil, or the like. The external additives may be used singly or in mixture of two or more kinds thereof.

Among them, inorganic oxide fine particles such as silica fine particles, alumina fine particles, and titania fine particles are preferably used as the external additive. Incidentally, the number average primary particle diameter of the external additive fine particles can be calculated from an electron micrograph.

The amount of the external additive (the total amount in the case of using two or more kinds) added is preferably from 0.05 to 5% by mass and more preferably from 0.1 to 3% by mass when the mass of the total mass of the toner containing the external additive is taken as 100% by mass.

[Method of Producing Toner for Electrostatic Charge Image Development]

Hereinafter, a method of producing the toner for electrostatic charge image development according to the present invention will be described.

The method of producing the toner of the present invention is not particularly limited, and examples thereof may include known methods such as a kneading pulverization method, a suspension polymerization method, an emulsion aggregation method, a dissolution suspension method, a polyester elongation method, and a dispersion polymerization method.

Among these, it is preferable to employ an emulsion aggregation method from the viewpoint of uniformity of particle diameter, controllability of shape, and the like. Hereinafter, the emulsion aggregation method will be described.

<Emulsion Aggregation Method>

The emulsion aggregation method is a method of producing toner particles in which a dispersion of particles of a binder resin (hereinafter, also referred to as the "binder resin particles") dispersed by using a surface active agent or a dispersion stabilizer is mixed with a dispersion of particles of a releasing agent (hereinafter, also referred to as the "releasing agent particles"), the particles are aggregated until to have a desired particle diameter, and further the binder resin particles are fused with one another to control the shape. Here, the particles of the binder resin may arbitrarily contain a colorant, a charge control agent, and the like.

In the case of producing the toner for electrostatic charge image development by the emulsion aggregation method, the production method according to a preferred embodiment includes:

(a) a step of preparing an amorphous polyester resin particle dispersion, a vinyl resin particle dispersion, and a releasing agent particle dispersion (hereinafter, also referred to as a preparing step), and (b) a step of mixing, aggregating, and fusing the amorphous polyester resin particle dispersion, the vinyl resin particle dispersion, and the releasing agent particle dispersion (hereinafter, also referred to as aggregation-fusion step).

Hereinafter, steps (a) and (b) and steps (c) to (g) to be arbitrarily carried out will be described in detail.

(a) Preparing Step

The step (a) includes a step of preparing an amorphous polyester resin particle dispersion, a step of preparing a vinyl resin particle dispersion, and a step of preparing a releasing agent particle dispersion, and if necessary, it further includes a step of preparing a crystalline resin particle dispersion, a step of preparing a colorant particle dispersion, and the like.

(a-1) Step of Preparing Amorphous Polyester Resin Particle Dispersion

The step of preparing an amorphous polyester resin particle dispersion is a step of preparing a dispersion of amorphous polyester resin particles by synthesizing an amorphous polyester resin forming the binder resin and dispersing this amorphous polyester resin in an aqueous medium in a fine particle form.

The method of producing the amorphous polyester resin is as described above, and the description thereon will be thus omitted here.

The amorphous polyester resin particle dispersion can be prepared, for example, by a method in which the amorphous polyester resin is subjected to a dispersion treatment in an aqueous medium without using a solvent or a method in which the amorphous polyester resin is dissolved in a solvent such as ethyl acetate or methyl ethyl ketone to prepare a solution, the solution is emulsified and dispersed in an aqueous medium by using a dispersing machine, and then a desolvation treatment is conducted.

In the present invention, the "aqueous medium" refers to one containing at least at 50% by mass or more of water. Examples of a component other than water may include an organic solvent which is soluble in water, and examples thereof may include methanol, ethanol, isopropanol, acetone, dimethylformamide, methyl cellosolve, and tetrahydrofuran. Among these, it is preferable to use an alcohol-based organic solvent such as methanol, ethanol, or isopropanol of an organic solvent which does not dissolve the resin. Preferably, only water is used as the aqueous medium.

In a case in which the amorphous polyester resin contains a carboxyl group in the structure, ammonia, sodium hydroxide, or the like may be added to the aqueous medium in order to ionically dissociate the carboxyl group, to stably emulsify the amorphous polyester resin in the aqueous phase, and thus to facilitate the emulsification. Furthermore, a dispersion stabilizer may be dissolved in the aqueous medium, and a surface active agent, resin particles, and the like may be added into the aqueous medium for the purpose of improving the dispersion stability of oil droplets.

As the dispersion stabilizer, known dispersion stabilizers can be used. For example, it is preferable to use those that are soluble in an acid or an alkali such as tricalcium phosphate or it is preferable to use those that are decomposable by enzymes from the environmental perspective. As the surface active agent, a known anionic surface active agent, cationic surface active agent, nonionic surface active agent, or amphoteric surface active agent can be used. In addition, examples of the resin particles for improving the dispersion stability may include polymethyl methacrylate resin particles, polystyrene resin particles, and polystyrene-acrylonitrile resin particles.

Such a dispersion treatment described above can be conducted by utilizing mechanical energy. The dispersing machine is not particularly limited, and examples thereof may include a homogenizer, a low-speed shearing type dispersing machine, a high-speed shearing type dispersing machine, a friction type dispersing machine, a high-pressure jet type dispersing machine, an ultrasonic dispersing machine, a high-pressure impact type dispersing machine, the ULTIMIZER, and an emulsifying and dispersing machine.

At the time of dispersion, it is preferable to heat the solution. The heating condition is not particularly limited, but it is usually about from 60 to 200° C.

The volume average particle diameter (volume-based median diameter) of the amorphous polyester resin particles in the amorphous polyester resin particle dispersion thus prepared is preferably from 60 to 1000 nm and more preferably from 80 to 500 nm. Incidentally, this volume average particle diameter can be controlled by the magnitude of mechanical energy at the time of emulsification and dispersion and the like.

In addition, the amount of the amorphous polyester resin particles in the amorphous polyester resin particle dispersion is preferably in a range of from 10 to 50% by mass, more preferably in a range of from 15 to 40% by mass relative to the total amount of the dispersion. It is possible to suppress the spread of particle size distribution and to improve the toner properties when the amount is in such a range.

(a-2) Step of Preparing Vinyl Resin Particle Dispersion

In the step of preparing a vinyl resin particle dispersion, an aqueous dispersion of a vinyl resin is prepared. In the case of obtaining the vinyl resin by conducting, for example, emulsion polymerization in an aqueous medium, the liquid after the polymerization reaction can be used as the vinyl resin particle dispersion as it is.

Alternatively, it is also possible to use a method in which the isolated vinyl resin is pulverized if necessary and the vinyl resin is then dispersed in an aqueous medium in the presence of a surface active agent by using an ultrasonic dispersing machine or the like. Specific examples of the aqueous medium and the surface active agent are the same as those in (a-1) described above, and the description thereon will be thus omitted here.

The volume average particle diameter (volume-based median diameter) of the vinyl resin particles in the vinyl resin particle dispersion is preferably from 60 to 1000 nm and more preferably from 80 to 500 nm. Incidentally, this volume average particle diameter can be controlled by the magnitude of mechanical energy at the time of polymerization and the like.

The amount of the vinyl resin particles in the vinyl resin particle dispersion is preferably in a range of from 10 to 50% by mass and more preferably in a range of from 15 to 40% by mass relative to the total amount of the dispersion. It is possible to suppress the spread of particle size distribution and to improve the toner properties when the amount is in such a range.

(a-3) Step of Preparing Releasing Agent Particle Dispersion

The step of preparing a releasing agent particle dispersion is a step of preparing a dispersion of releasing agent particles by dispersing the releasing agent in an aqueous medium in a fine particle form.

The aqueous medium is as described in (a-1) above, and a surface active agent, resin particles, and the like may be added into this aqueous medium for the purpose of improving the dispersion stability.

Dispersion of the releasing agent can be conducted by utilizing mechanical energy. Such a dispersing machine is not particularly limited and those described in (a-1) above can be used.

The volume average particle diameter (volume-based median diameter) of the releasing agent particles in the releasing agent particle dispersion is preferably in a range of from 10 to 300 nm.

The amount of the releasing agent particles in the releasing agent particle dispersion is preferably in a range of from 10 to 50% by mass and more preferably in a range of from 15 to 40% by mass relative to the total amount of the dispersion. An effect of preventing hot offset and securing separability is obtained when the amount is in such a range.

(a-4) Step of Preparing Crystalline Resin Particle Dispersion

The step of preparing a crystalline resin particle dispersion is carried out if necessary in the case of desiring a toner containing a crystalline resin. The step of preparing a crystalline resin particle dispersion is a step of preparing a dispersion of crystalline resin particles by synthesizing a crystalline resin forming the binder resin and dispersing this crystalline resin in an aqueous medium in a fine particle form.

The method of producing the crystalline resin is as described above, and the description thereon will be thus omitted here.

In addition, the method of preparing the dispersion is as described in (a-1) above, and the description thereon will be thus omitted here.

The volume average particle diameter (volume-based median diameter) of the crystalline resin particles in the crystalline resin particle dispersion is preferably from 60 to 1000 nm and more preferably from 70 to 500 nm. Incidentally, this volume average particle diameter can be controlled by the magnitude of mechanical energy at the time of emulsification and dispersion and the like.

In addition, the amount of the crystalline resin particles in the crystalline resin particle dispersion is preferably in a range of from 10 to 50% by mass and more preferably in a range of from 15 to 40% by mass relative to the total amount of dispersion. It is possible to suppress the spread of particle size distribution and to improve the toner properties when the amount is in such a range.

(a-5) Step of Preparing Colorant Particle Dispersion

The step of preparing a colorant particle dispersion is carried out if necessary in the case of desiring a toner containing a colorant, and it is a step of preparing a dispersion of colorant particles by dispersing the colorant in an aqueous medium in a fine particle form.

The aqueous medium is as described in (a-1) above, and the description thereon will be thus omitted here. A surface active agent, resin particles, and the like may be added into this aqueous medium for the purpose of improving the dispersion stability.

Dispersion of the colorant can be conducted by using a dispersing machine utilizing mechanical energy. Such a dispersing machine is not particularly limited and those described in (a-1) above can be used.

The volume average particle diameter (volume-based median diameter) of the colorant particles in the colorant particle dispersion is preferably in a range of from 10 to 300 nm.

The amount of the colorant in the colorant particle dispersion is preferably in a range of from 10 to 50% by mass and more preferably in a range of from 15 to 40% by mass relative to the total amount of the dispersion. There is an effect of securing color reproducibility when the amount is in such a range.

(b) Aggregation-Fusion Step

This aggregation-fusion step is a step of aggregating the amorphous polyester resin particles, vinyl resin particles, releasing agent particles, and if necessary, crystalline resin particles and colorant particles described above in the aqueous medium and fusing these particles at the same time.

In this step, first, the amorphous polyester resin particle dispersion, the vinyl resin particle dispersion, the releasing agent particle dispersion, and if necessary, the crystalline resin particle dispersion and the colorant particle dispersion are mixed together and these particles are dispersed in the aqueous medium.

Next, an aggregating agent is added to the mixed dispersion, the mixed dispersion is heated at a temperature equal to or higher than the glass transition points of the amorphous polyester resin particles and the vinyl resin particles so that aggregation of the particles and fusion of the resin particles proceed at the same time.

The aggregating agent is not particularly limited, but those selected from metal salts such as an alkali metal salt and a Group 2 metal salt are suitably used. Examples of the metal salt may include a monovalent metal salt of sodium, potassium, lithium, or the like; a divalent metal salt of calcium, magnesium, manganese, copper, or the like; and a trivalent metal salt of iron, aluminum, or the like. Examples of the specific metal salt may include sodium chloride, potassium chloride, lithium chloride, calcium chloride, magnesium chloride, zinc chloride, copper sulfate, magnesium sulfate, manganese sulfate, and aluminum sulfate. Among these, it is particularly preferable to use a divalent or trivalent metal salt since it is possible to advance the aggregation by using a smaller amount. These aggregating agents may be used singly or in combination of two or more kinds thereof.

The amount of the aggregating agent used is not particularly limited, but it is preferably from 0.1 to 5 parts by mass and more preferably from 0.3 to 4.5 parts by mass relative to 100 parts by mass of the solids of binder resin forming the toner particles.

In the aggregating step, it is preferable to start the heating of the resin particle dispersion for aggregation as soon as possible after the aggregating agent is added thereto. The reason for this is not clear, but this is because there is a possibility that the aggregation state of the particles fluctuates with the elapse of the standing time, thus the particle size distribution of the toner particles to be obtained is unstable or the surface property fluctuates. The standing time is usually within 30 minutes and preferably within 10 minutes.

In addition, in the aggregating step, it is preferable to quickly increase the temperature of the dispersion for aggregation by heating after the aggregating agent is added thereto, and it is preferable to set the rate of temperature increase to 0.05° C./min or more. The upper limit of the rate of temperature increase is not particularly limited, but it is preferably set to 15° C./min or less from the viewpoint of suppressing the generation of coarse particles due to the rapid progress of fusion. Furthermore, it is important to continue fusion by maintaining the temperature of the dispersion for aggregation for a certain period of time and preferably until the volume average particle diameter (volume-based median diameter) reaches 4.5 to 7.0 μm after the temperature of the dispersion for aggregation has reached a desired temperature.

It is preferable that the aggregation-fusion step of the toner of the present invention is carried out particularly by the following procedure. In other words, (I) the amorphous polyester resin particle dispersion and, if necessary, the crystalline resin particle dispersion and the colorant particle dispersion are mixed together, (II) an aggregating agent is added to the mixture to advance the aggregation of the particles and fusion of the resin particles at the same time, and (III) the amorphous polyester resin particle dispersion, the vinyl resin particle dispersion, and the releasing agent particle dispersion are further added to the resultant. By carrying out the aggregation-fusion step by such a procedure, it is possible to obtain toner particles having a form in which the releasing agent is not exposed and the vinyl resin and the releasing agent are present in the vicinity of the surface of the toner particles.

(c) Aging Step

This step is carried out if necessary. In the aging step, an aging treatment is conducted in which the aggregate particles obtained by the aggregation-fusion step are aged by thermal energy until to have a desired shape so that toner particles are formed.

Specifically, the aging treatment is conducted by heating and stirring the mixture in which the aggregate particles are dispersed and adjusting the heating temperature, the stirring speed, the heating time, and the like until the shape of the aggregate particles has a desired circularity.

(d) Cooling Step

This step is a step of subjecting the dispersion of the toner particles to a cooling treatment. As the condition of the cooling treatment, it is preferable to cool the dispersion of the toner particles at a cooling rate of from 1 to 20° C./min. The specific method of cooling treatment is not particularly limited, and examples thereof may include a method in which the dispersion of the toner particles is cooled by introducing a refrigerant from the outside of the reaction vessel and a method in which the dispersion of the toner particles is cooled by directly introducing cold water into the reaction system.

(e) Filtering and Washing Step

This step is a step of separating the toner particles from the dispersion of the toner particles which is cooled in the above-mentioned step through solid-liquid separation and removing and washing the attached substances such as the surface active agent and the aggregating agent from the toner cake (an aggregate obtained by aggregating the toner particles in a wet state into a cake form) obtained through the solid-liquid separation.

The method of a solid-liquid separation is not particularly limited, and it is possible to use a centrifugal separation method, a vacuum filtration method using the Nutsche Filter or the like, a filtration method using a filter press or the like, and the like.

(f) Drying Step

This step is a step of drying the toner cake subjected to the washing treatment, and it can be carried out according to the drying step in a known production method of toner particles to be generally employed.

Specifically, examples of the dryer to be used for drying of the toner cake may include a spray dryer, a vacuum freeze dryer, and a reduced pressure dryer, and it is preferable to use a stationary shelf dryer, a mobile shelf dryer, a fluidized bed dryer, a rotary dryer, a stirring dryer, and the like.

(g) External Additive Adding Step

This step is carried out if necessary in the case of adding an external additive to the toner particles.

As the external additive mixing device, it is possible to use a mechanical mixing device such as HENSCHEL mixer, a coffee mill, or a sample mill.

<Developer>

The toner of the present invention can be used as a magnetic or nonmagnetic one-component developer, but it may be used as a two-component developer by being mixed with a carrier. In the case of using the toner as a two-component developer, it is possible to use magnetic particles composed of a known material such as a metal such as iron, ferrite, or magnetite or an alloy of these metals with a metal such as aluminum or lead as the carrier, and ferrite particles are particularly preferable. In addition, a coated carrier obtained by coating the surface of magnetic particles with a coating agent such as a silicone resin, a dispersion type carrier obtained by dispersing a magnetic fine powder in a binder resin, or the like may be used as the carrier.

The volume-based median diameter of the carrier is preferably from 20 to 100 μm and more preferably from 25 to 80 μm. The volume-based median diameter of the carrier can be typically measured by using a laser diffraction type particle size distribution measuring instrument "HELOS" (manufactured by Sympatec GmbH) equipped with a wet type dispersing machine.

The two-component developer can be prepared by mixing the carrier and the toner by using a mixing device. Examples of the mixing device may include HENSCHEL MIXER, NAUTA MIXER, and a V type mixer.

The amount of the toner blended when preparing the two-component developer according to the present invention is preferably from 1 to 10% by mass relative to 100% by mass of the sum of the carrier and the toner.

Although embodiments of the present invention have been described and illustrated in detail, it is clearly understood that the same is by way of illustration and example only and not limitation, the scope of the present invention should be interpreted by terms of the appended claims.

EXAMPLES

Hereinafter, the embodiments of the present invention will be specifically described with reference to Examples, but the present invention is not limited thereto. In the following Examples, the terms "parts" and "%" mean "parts by mass" and "% by mass", respectively, unless otherwise stated, and the respective operations were conducted at room temperature (25° C.). Incidentally, the glass transition temperature, melting point, weight average molecular weight, and number average molecular weight of the resins, the melting point of the releasing agent, and the acid value of the resins and the releasing agent were measured by the following methods.

<<Glass Transition Temperature of Amorphous Resin and Melting Point of Crystalline Resin>>

The glass transition temperatures (Tg) of the amorphous polyester resin and the vinyl resin were measured by using the "Diamond DSC" (manufactured by PerkinElmer Inc.). First, 3.0 mg of the measurement sample (resin) was sealed in an aluminum pan and the aluminum pan is set in the sample holder of the "Diamond DSC". The empty aluminum pan was used as the reference. Thereafter, a DSC curve was obtained under the measurement conditions (temperature raising and cooling conditions) to pass, in the following order, a first temperature raising process of raising the temperature from 0 to 200° C. at a rate of 10° C./min, a cooling process of lowering the temperature from 200 to 0° C. at a rate of 10° C./min, and a second temperature raising process of raising the temperature from 0 to 200° C. at a rate of 10° C./min. Based on the DSC curve obtained by this measurement, the extension line of the base line prior to the rise of the first endothermic peak in the second temperature raising process and the tangent line indicating the maximum slope between the rising portion of the first peak to the peak apex were drawn, and the intersection point of both lines was taken as the glass transition temperature (Tg).

In addition, with regard to the melting point of the crystalline resin, the temperature at the peak top of the endothermic peak (endothermic peak of which the full width at half maximum was 15° C. or less) attributed to the crystalline resin in the second temperature raising process was taken as the melting point (Tc) based on the DSC curve obtained in the same manner as the above.

<<Weight Average Molecular Weight and Number Average Molecular Weight of Resin>>

The molecular weight (weight average molecular weight and number average molecular weight) of each resin by GPC was measured as follows. Specifically, using an apparatus "HLC-8120 GPC" (manufactured by Tosoh Corporation) and a column "TSK GUARD COLUMN+TSKGEL SUPER HZ-M TRIPLE" (manufactured by Tosoh Corporation), tetrahydrofuran (THF) as a carrier solvent was allowed to flow at a flow rate of 0.2 mL/min while maintaining the column temperature at 40° C. The measurement sample (resin) was dissolved in tetrahydrofuran so as to have a concentration of 1 mg/ml. The solution was prepared by a treatment using an ultrasonic dispersing machine at room temperature for 5 minutes. Subsequently, the solution was filtered through a membrane filter having a pore size of 0.2 μm to obtain a sample solution, and 10 μL of this sample solution was injected into the apparatus together with the above carrier solvent. A refractive index detector (RI detector) was used for detection. The molecular weight distribution of the measurement sample was calculated based on a calibration curve obtained by using monodisperse polystyrene standard particles. The polystyrene used for obtaining the calibration curve was 10 samples.

<<Melting Point of Releasing Agent>>

The melting point of the releasing agent was measured by differential scanning calorimetry (DSC). Specifically, the sample was filled in the aluminum pan KIT NO. B0143013, the aluminum pan was set in a sample holder of a thermal analyzer Diamond DSC (manufactured by PerkinElmer Inc.), and the temperature of the sample was changed in the order of heating, cooling, and heating. The temperature was raised from room temperature (25° C.) at the time of the first heating and from 0° C. at the time of the second heating to 150° C. at a rate of 10° C./min, maintained at 150° C. for 5 minutes, and lowered from 150 to 0° C. at a rate of 10° C./min at the time of cooling, and maintained at 0° C. for 5 minutes. The temperature at the peak top of the endothermic peak in the endothermic curve obtained at the time of the second heating was taken as the melting point of the releasing agent.

<<Acid Value of Resin and Releasing Agent>>

(Preparation of Reagent)

A phenolphthalein solution was prepared by dissolving 1.0 g of phenolphthalein in 90 mL of ethyl alcohol (95% by volume) and adding ion exchanged water to the solution to make 100 mL. In 5 mL of ion exchanged water, 7 g of JIS special grade potassium hydroxide was dissolved and ethyl alcohol (95% by volume) was added to the solution to make 1 L. The solution was put in an alkali-resistant container so as not to come into contact with carbon dioxide gas, allowed to stand for 3 days, and filtered, thereby preparing a potassium hydroxide solution. The standardization was conducted in conformity to the description in JIS K 0070-1966.

(Main Test)

Into a 200 mL Erlenmeyer flask, 100 mL of a mixed solution of toluene and ethanol (volume ratio 2:1) was added, and 2.0 g of the pulverized sample which was accurately weighed was dissolved over 5 hours. Subsequently, several drops of the phenolphthalein solution prepared as an indicator were added to the solution, and the titration was conducted by using the potassium hydroxide solution prepared as the above. Incidentally, it was defined that the endpoint of the titration was reached when the light crimson color of the indicator continued for about 30 seconds.

(Blank Test)

The same operation as in the main test was conducted except that the sample was not used (that is, only a mixed solution of toluene and ethanol (volume ratio 2:1) was used).

(Calculation of Acid Value)

The titration results of the main test and the blank test were substituted into the following Equation (1) to calculate the acid value.

$$A=[(C-B)\times f\times 5.6]/S \quad \text{Equation (1)}$$

A: Acid value (mg KOH/g)

B: Amount of potassium hydroxide solution added at blank test (mL)

C: Amount of potassium hydroxide solution (mL) added at main test f: Factor of 0.1 mol/L potassium hydroxide ethanol solution S: Mass of sample (g)

<Preparation of Amorphous Polyester Resin Particle Dispersion>

Production Example 1: Preparation of Amorphous Polyester Resin Particle Dispersion <<Preparation of Amorphous Polyester Resin (A1)>>

Bisphenol A ethylene oxide (2.2 mol) adduct: 40 parts by mole

Bisphenol A propylene oxide (2.2 mol) adduct: 60 parts by mole

Dimethyl terephthalate: 60 parts by mole

Dimethyl fumarate: 15 parts by mole

Dodecenylsuccinic anhydride: 20 parts by mole

Trimellitic anhydride: 5 parts by mole

Into a reaction vessel equipped with a stirrer, a thermometer, a condenser, and a nitrogen gas introducing tube, the above monomers other than dimethyl fumarate and trimellitic anhydride and 0.25 parts by mass of tin dioctylate relative to 100 parts by mass of the sum of the above monomers were added. The mixture was reacted at 235° C. for 6 hours in a nitrogen gas stream, the temperature of the resultant was then lowered to 200° C., dimethyl fumarate and trimellitic anhydride were added thereto, and the mixture was reacted for 1 hour. The temperature of the resultant was raised to 220° C. over 5 hours, and the resultant was polymerized under a pressure of 10 kPa until to have a desired molecular weight, thereby obtaining a pale yellow transparent amorphous polyester resin (A1).

The amorphous polyester resin (A1) had a weight average molecular weight of 35,000, a number average molecular weight of 8,000, a glass transition temperature (Tg) of 59° C., and an acid value of 16.2 mg KOH/g.

<<Preparation of Amorphous Polyester Resin Particle Dispersion (a1)>>

Next, the amorphous polyester resin (A1) thus obtained was dispersed by using a dispersing machine obtained by modifying the CAVITRON CD1010 (manufactured by EUROTEC, LTD.) to a high temperature and high pressure type. An amorphous polyester resin dispersion was prepared so as to have a composition ratio in which ion exchanged water was 80% by mass and the concentration of the amorphous polyester resin (A1) was 20% by mass. At this time, the pH of the dispersion was adjusted to 8.5 with ammonia, and the CAVITRON was operated under the condition that the rotational speed of the rotor was 60 Hz, the pressure was 5 Kg/cm$^2$, and the temperature was 140° C. maintained by a heat exchanger. Thereafter, ion exchanged water was added to the above dispersion to adjust the solid content to 20% by mass, thereby preparing an amorphous polyester resin particle dispersion (a1). The volume-based median diameter ($D_{50}$) of this dispersion was measured by using the MICROTRAC UPA-150 (manufactured by NIKKISO CO., LTD.), and it was 160 nm.

<Preparation of Amorphous Vinyl Resin Particle Dispersion>

Production Example 2: Preparation of Amorphous Vinyl Resin Particle Dispersion (b1)

Into a 5 L reaction vessel equipped with a stirring device, a temperature sensor, a cooling tube, and a nitrogen introducing device, 5.0 parts by mass of sodium lauryl sulfate and 2,500 parts by mass of ion exchanged water were added, and the internal temperature of the reaction vessel was raised to 80° C. while stirring the mixture at a stirring speed of 230 rpm in a nitrogen stream.

Subsequently, a solution prepared by dissolving 15.0 parts by mass of potassium persulfate (KPS) in 287 parts by mass of ion exchanged water was added thereto, and the liquid temperature was adjusted to 80° C. Furthermore, a mixed monomer liquid composed of 900.0 parts by mass of styrene (St), 282.0 parts by mass of n-butyl acrylate (BA), 12.0 parts by mass of acrylic acid (AA), 6.0 parts by mass of 1,10-decanediol diacrylate, and 8.1 parts by mass n-octyl mercaptan was added dropwise to the resultant solution over 2 hours. After the dropwise addition was completed, the mixture was heated and stirred at 80° C. for 2 hours for the polymerization, thereby obtaining an amorphous vinyl resin dispersion. Ion exchanged water was added to the above dispersion to adjust the solid content to 30% by mass, thereby preparing a dispersion (b1) of amorphous vinyl resin (B1) particles. The volume-based median diameter ($D_{50}$) of this dispersion was measured by using the MICROTRAC UPA-150 (manufactured by NIKKISO CO., LTD.), and it was 130 nm.

The amorphous vinyl resin (B1) had a glass transition temperature (Tg) of 50° C., a weight average molecular weight (Mw) of 80,000, a number average molecular weight (Mn) of 22,000, and an acid value of 10.0 mg KOH/g.

Production Examples 3 to 17: Preparation of Amorphous Vinyl Resin Particle Dispersions (b2) to (b16)

Dispersions (b2) to (b16) of amorphous vinyl resin (B2) to (B16) particles were prepared in the same manner as in the preparation of the amorphous vinyl resin particle dispersion (b1) except that monomers represented by General Formula (1) in Table 1 were used and the amount (parts by mass) of each monomer used was changed for the mixed monomer liquid. The weight average molecular weight (Mw), the number average molecular weight (Mn), and the acid value of the amorphous vinyl resins (B2) to (B16) thus obtained were as presented in Table 1. In addition, the glass transition temperature (Tg) of these amorphous vinyl resins (B2) to (B16) was in a range of from 40 to 65° C.

<Preparation of Crystalline Polyester Resin Particle Dispersion>

Production Example 18: Preparation of Crystalline Polyester Resin Particle Dispersion (c1)

<<Preparation of Crystalline Polyester Resin (C1)>>

Dodecanedioic acid: 50 parts by mole 1,9-Nonanediol: 50 parts by mole

Into a reaction vessel equipped with a stirrer, a thermometer, a condenser, and a nitrogen gas introducing tube, the above monomers were added, and the interior of the reaction vessel was purged with dry nitrogen gas. Subsequently, 0.25 parts by mass of titanium tetrabutoxide ($Ti(O\text{-}n\text{-}Bu)_4$) relative to 100 parts by mass of the sum of the above monomers was added into the reaction vessel. The mixture was reacted by stirring at 170° C. for 3 hours under a nitrogen gas stream, the temperature of the reaction vessel was further raised to 210° C. over 1 hour, the pressure in the reaction vessel was decreased to 3 kPa, and the resultant mixture was reacted by stirring for 13 hours under reduced pressure, thereby obtaining a crystalline polyester resin (C1).

The crystalline polyester resin (C1) had a weight average molecular weight of 23,000, a number average molecular weight of 6,500, an acid value of 19.1 mg KOH/g, and a melting point of 73.2° C.

<<Preparation of Crystalline Polyester Resin Particle Dispersion (c1)>>

Next, the crystalline polyester resin (C1) thus obtained was dispersed by using a dispersing machine obtained by modifying the CAVITRON CD1010 (manufactured by EUROTEC, LTD.) to a high temperature and high pressure type. A crystalline polyester resin dispersion was prepared so as to have a composition ratio in which ion exchanged water was 80% by mass and the concentration of the crystalline polyester resin (C1) was 20% by mass. At this time, the pH of the dispersion was adjusted to 8.5 with ammonia, and the CAVITRON was operated under the condition that the rotational speed of the rotor was 60 Hz, the pressure was 5 $Kg/cm^2$, and the temperature was 140° C. maintained by a heat exchanger. Thereafter, ion exchanged water was added to the above dispersion to adjust the solid content to 20% by mass, thereby preparing a crystalline

TABLE 1

| | | | | | Monomer represented by General Formula (1) | | | | | | | |
|---|---|---|---|---|---|---|---|---|---|---|---|---|
| Dispersion No. | Resin No. | Styrene [parts by mass] | n-Butyl acrylate [parts by mass] | Acrylic acid [parts by mass] | $R^1$ | $R^2$ | n | Amount [Parts by mass] | n-Octyl mercaptan [parts by mass] | Weight average molecular weight | Number average molecular weight | Acid value [mgKOH/g] |
| b1 | B1 | 900.0 | 282.0 | 12.0 | H | H | 10 | 6.0 | 8.1 | 80,000 | 22,000 | 10.0 |
| b2 | B2 | 900.0 | 282.0 | 12.0 | H | H | 8 | 6.0 | 8.1 | 80,000 | 22,000 | 10.0 |
| b3 | B3 | 910.4 | 282.0 | 1.6 | H | H | 10 | 6.0 | 8.1 | 80,000 | 22,000 | 1.0 |
| b4 | B4 | 865.2 | 282.0 | 46.8 | H | H | 10 | 6.0 | 8.1 | 80,000 | 22,000 | 30.0 |
| b5 | B5 | 900.0 | 282.0 | 12.0 | H | H | 12 | 6.0 | 8.1 | 80,000 | 22,000 | 10.0 |
| b6 | B6 | 900.0 | 282.0 | 12.0 | H | H | 18 | 6.0 | 8.1 | 80,000 | 22,000 | 10.0 |
| b7 | B7 | 900.0 | 282.0 | 12.0 | $CH_3$ | $CH_3$ | 10 | 6.0 | 8.1 | 80,000 | 22,000 | 10.0 |
| b8 | B8 | 858.0 | 282.0 | 54.0 | H | H | 12 | 6.0 | 17.8 | 25,000 | 7,800 | 35.0 |
| b9 | B9 | 900.0 | 282.0 | 12.0 | H | H | 12 | 6.0 | 16.2 | 30,000 | 9,800 | 10.0 |
| b10 | B10 | 900.0 | 282.0 | 12.0 | H | H | 12 | 6.0 | 1.6 | 200,000 | 53,000 | 10.0 |
| b11 | B11 | 911.6 | 282.0 | 0.4 | H | H | 12 | 6.0 | 1.2 | 220,000 | 57,000 | 0.2 |
| b12 | B12 | 900.0 | 282.0 | 12.0 | H | H | 28 | 6.0 | 8.1 | 80,000 | 22,000 | 10.0 |
| b13 | B13 | 900.0 | 282.0 | 12.0 | H | H | 2 | 6.0 | 8.1 | 80,000 | 22,000 | 10.0 |
| b14 | B14 | 900.0 | 282.0 | 12.0 | H | H | 40 | 6.0 | 8.1 | 80,000 | 22,000 | 10.0 |
| b15 | B15 | 904.8 | 282.0 | 12.0 | H | H | 12 | 1.2 | 8.1 | 50,000 | 15,000 | 10.0 |
| b16 | B16 | 846.0 | 282.0 | 12.0 | H | H | 12 | 60.0 | 8.1 | 150,000 | 48,000 | 10.0 |

polyester resin particle dispersion (c1). The volume-based median diameter ($D_{50}$) of this dispersion was measured by using the MICROTRAC UPA-150 (manufactured by NIKKISO CO., LTD.), and it was 190 nm.

Production Example 19: Preparation of Releasing Agent Particle Dispersion (W1)

Ester wax
(ester wax which has a melting point of 74° C. and an acid value of 0.1 mg KOH/g and contains behenyl behenate as a main component): 100 parts by mass
Anionic surface active agent
(NEOGEN RK manufactured by DKS Co., Ltd.): 10 parts by mass
Ion exchanged water: 400 parts by mass The above materials were mixed, heated to 80° C., and sufficiently dispersed by using the ULTRA-TURRAX T50 manufactured by IKA. Thereafter, a dispersion treatment was conducted by using a pressure discharge type Gaulin homogenizer, and ion exchanged water was then added to the dispersion to adjust the solid content to 15% by mass, thereby preparing a releasing agent particle dispersion (W1). The volume-based median diameter of the releasing agent particles in this dispersion was measured by using a laser diffraction type particle size distribution measuring instrument LA-750 (manufactured by HORIBA, Ltd.), and it was 220 nm.

Production Example 20: Preparation of Releasing Agent Particle Dispersion (W2)

A releasing agent particle dispersion (W2) was prepared in the same manner as in the preparation of the releasing agent particle dispersion (W1) except that the releasing agent was changed to an ester wax which had a melting point of 67° C. and an acid value of 0.1 mg KOH/g and contains stearyl stearate as a main component. The volume-based median diameter of the releasing agent particles in this dispersion was measured by using a laser diffraction type particle size distribution measuring instrument LA-750 (manufactured by HORIBA, Ltd.), and it was 180 nm.

Production Example 21: Preparation of Releasing Agent Particle Dispersion (W3)

A releasing agent particle dispersion (W3) was prepared in the same manner as in the preparation of the releasing agent particle dispersion (W1) except that the releasing agent was changed to an ester wax which had a melting point of 84° C. and an acid value of 0.1 mg KOH/g and contains pentaerythritol tetrabehenate as a main component. The volume-based median diameter of the releasing agent particles in this dispersion was measured by using a laser diffraction type particle size distribution measuring instrument LA-750 (manufactured by HORIBA, Ltd.), and it was 290 nm.

Production Example 22: Preparation of Releasing Agent Particle Dispersion (W4)

A releasing agent particle dispersion (W4) was prepared in the same manner as in the preparation of the releasing agent particle dispersion (W1) except that the releasing agent was changed to an ester wax which had a melting point of 71° C. and an acid value of 2.4 mg KOH/g and contains behenyl behenate as a main component. The volume-based median diameter of the releasing agent particles in this dispersion was measured by using a laser diffraction type particle size distribution measuring instrument LA-750 (manufactured by HORIBA, Ltd.), and it was 180 nm.

Production Example 23: Preparation of Releasing Agent Particle Dispersion (W5)

A releasing agent particle dispersion (W5) was prepared in the same manner as in the preparation of the releasing agent particle dispersion (W1) except that the releasing agent was changed to an ester wax which had a melting point of 63° C. and an acid value of 10 mg KOH/g and contains distearyl adipate as a main component. The volume-based median diameter of the releasing agent particles in this dispersion was measured by using a laser diffraction type particle size distribution measuring instrument LA-750 (manufactured by HORIBA, Ltd.), and it was 220 nm.

Production Example 24: Preparation of Releasing Agent Particle Dispersion (W6)

A releasing agent particle dispersion (W6) was prepared in the same manner as in the preparation of the releasing agent particle dispersion (W1) except that the releasing agent was changed to an ester wax which had a melting point of 95° C. and an acid value of 101 mg KOH/g and contains a carboxylic acid-terminated synthetic ester-based wax as a main component. The volume-based median diameter of the releasing agent particles in this dispersion was measured by using a laser diffraction type particle size distribution measuring instrument LA-750 (manufactured by HORIBA, Ltd.), and it was 310 nm.

Production Example 25: Preparation of Releasing Agent Particle Dispersion (W7)

A releasing agent particle dispersion (W7) was prepared in the same manner as in the preparation of the releasing agent particle dispersion (W1) except that the releasing agent was changed to a paraffin wax (hydrocarbon-based wax) having a melting point of 75° C. and an acid value of 0 mg KOH/g. The volume-based median diameter of the releasing agent particles in this dispersion was measured by using a laser diffraction type particle size distribution measuring instrument LA-750 (manufactured by HORIBA, Ltd.), and it was 150 nm.

<Preparation of Colorant Particle Dispersion>

Production Example 26: Preparation of Black Colorant Particle Dispersion (1)

Carbon black
(REGAL 330 manufactured by Cabot Corporation): 100 parts by mass
Anionic surface active agent (NEOGEN SC manufactured by DKS Co., Ltd.): 15 parts by mass
Ion exchanged water: 400 parts by mass The above components were mixed, preliminarily dispersed for 10 minutes by using a homogenizer (ULTRA-TURRAX manufactured by IKA), and then subjected to a dispersion treatment using a high pressure impact type dispersing machine ULTIMIZER (manufactured by SUGINO MACHINE LIMITED) at a pressure of 245 MPa for 30 minutes, thereby obtaining an aqueous dispersion of black colorant particles. Ion exchanged water was further added to the dispersion thus obtained so as to adjust the solid content to 15% by mass, thereby preparing a black colorant particle dispersion (1). The volume-based median diameter ($D_{50}$) of the colorant particles in this dispersion was measured by using the MICROTRAC UPA-150 (manufactured by NIKKISO CO., LTD.), and it was 110 nm.

<Production of Toner>

Example 1: Production of Toner (1)

<<Aggregation-Fusion Step and Aging Step>>

Amorphous polyester resin particle dispersion (a1): 1200 parts by mass

Crystalline polyester resin particle dispersion (c1): 192 parts by mass

Black colorant dispersion (1): 160 parts by mass

Ion exchanged water: 1500 parts by mass

The above materials were added into a 4 L reaction vessel equipped with a thermometer, a pH meter, and a stirrer, and the pH of the mixture was adjusted to 3.0 at 25° C. by adding 1.0% nitric acid. Thereafter, 100 parts by mass of an aqueous solution of aluminum sulfate (as an aggregating agent) having a concentration of 2% was added to the mixture over 30 minutes while dispersing the mixture at 3,000 rpm by using a homogenizer (ULTRA-TURRAX T50 manufactured by IKA). After the dropwise addition was completed, the mixture was stirred for 10 minutes to thoroughly mix the raw materials and the aggregating agent.

Thereafter, a stirrer and a mantle heater were installed to the reaction vessel, and the temperature of the mixture was raised to 40° C. at a rate of 0.2° C./min and it was raised at a rate of 0.05° C./min after it exceeds 40° C. while adjusting the rotational speed of the stirrer so that the slurry was thoroughly stirred. The particle diameter was measured every 10 minutes by using the COULTER MULTISIZER 3 (aperture diameter: 50 μm, manufactured by Beckman Coulter, Inc.). The temperature was maintained when the volume-based median diameter reached 5.0 μm, and a mixed liquid of:

Amorphous polyester resin particle dispersion (a1): 480 parts by mass

Amorphous vinyl resin particle dispersion (b1): 144 parts by mass

Releasing agent particle dispersion liquid (W1): 256 parts by mass which had been mixed in advance was added to the slurry over 20 minutes.

Subsequently, after the resultant was maintained at 50° C. for 30 minutes, 8 parts of a 20% solution of EDTA (ethylenediaminetetraacetic acid) was added to the reaction vessel, and a 1 mol/L aqueous solution of sodium hydroxide was then add thereto to adjust the pH of the raw material dispersion to 9.0. Thereafter, the temperature of the dispersion was raised to 85° C. at rate of 1° C./min while adjusting the pH to 9.0 every 5° C., and the temperature was maintained at 85° C.

<<Cooling Step>>

Thereafter, the dispersion was cooled at a rate of 10° C./min when the shape factor analyzed by the "FPIA-2100" reached 0.960, thereby obtaining a toner particle dispersion (1).

<<Filtering and Washing Step and Drying Step>>

Thereafter, the toner particle dispersion (1) was filtered and thoroughly washed with ion exchanged water. Subsequently, the filtered substance was dried at 40° C. to obtain toner particles (1). The toner particles (1) thus obtained had a volume-based median diameter of 6.0 μm and an average circularity of 0.961.

<<External Additive Adding Step>>

To 100 parts by mass of the toner particles (1) thus obtained, 1.6 parts by mass of hydrophobic silica (number average primary particle diameter=12 nm) and 0.6 parts by mass of hydrophobic titanium oxide (number average primary particle diameter=20 nm) were added, the mixture was mixed for 20 minutes at a circumferential speed of the rotary blade of 35 mm/sec by using HENSCHEL MIXER (manufactured by NIPPON COKE & ENGINEERING CO., LTD.), thereby obtaining a toner (1) having a volume-based median diameter of 6.0 μm. The number average primary particle diameter of the respective external additives was determined by the method described above.

Incidentally, with regard to the vinyl resin contained in the toner particles (1), the amount (the contained proportion) of the constitutional unit derived from the monomer represented by General Formula (1) relative to the total amount of the constitutional units constituting the vinyl resin is presented in Table 2-1 (the item "Amount in vinyl resin"). This value was calculated from the mass ratio of the monomers used as the raw material, and it was confirmed to be consistent with the value by NMR measurement.

Examples 2 to 5: Production of Toners (2) to (5)

Toners (2) to (5) were obtained in the same manner as in Example 1 except that the amorphous vinyl resin particle dispersion (b1) was changed to the amorphous vinyl resin particle dispersions (b2) to (b5).

Examples 6 to 8: Production of Toners (6) to (8)

Toners (6) to (8) were obtained in the same manner as in Example 5 except that the releasing agent particle dispersion (W1) was changed to the releasing agent particle dispersions (W2) to (W4), respectively.

Examples 9 to 17: Production of Toners (9) to (17)

Toners (9) to (17) were obtained in the same manner as in Example 1 except that the amorphous vinyl resin particle dispersion (b1) was changed to the amorphous vinyl resin particle dispersions (b6) to (b12), (b15), and (b16), respectively.

Examples 18 and 19: Production of Toners (18) and (19)

Toners (18) and (19) were obtained in the same manner as in Example 5 except that the amounts of the amorphous polyester resin particle dispersion (a1) and the amorphous vinyl resin particle dispersion (b5) were changed so as to be the values presented in Table 2-1, respectively. Incidentally, the item "Amount in toner" in the table indicates the contained proportion of the resin when the mass of the toner which does not contain the external additives is taken as 100% by mass.

Comparative Example 1 Production of Toner (20)

A toner (20) was obtained in the same manner as in Example 5 except that:

Amorphous polyester resin particle dispersion (a1): 1200 parts by mass

Crystalline polyester resin particle dispersion (c1): 192 parts by mass

Black colorant dispersion (1): 160 parts by mass

Ion exchanged water: 1500 parts by mass were changed to
Amorphous vinyl resin particle dispersion (b5): 800 parts by mass
Crystalline polyester resin particle dispersion (c1): 192 parts by mass
Black colorant dispersion (1): 160 parts by mass
Ion exchanged water: 1900 parts by mass and
Amorphous vinyl resin particle dispersion (b1): 144 parts by mass was changed to
Amorphous vinyl resin particle dispersion (b5): 144 parts by mass.

Comparative Examples 2 and 3: Production of Toners (21) and (22)

Toners (21) and (22) were obtained in the same manner as in Example 1 except that the amorphous vinyl resin particle dispersion (b1) was changed to the amorphous vinyl resin particle dispersions (b13) and (b14), respectively.

Comparative Example 4: Production of Toner (23)

A toner (23) was obtained in the same manner as in Example 1 except that the mixed liquid of
Amorphous polyester resin particle dispersion (a1): 480 parts by mass
Amorphous vinyl resin particle dispersion (b1): 144 parts by mass
Releasing agent particle dispersion liquid (W1): 256 parts by mass was changed to a mixed liquid of
Amorphous polyester resin particle dispersion (a1): 696 parts by mass
Releasing agent particle dispersion liquid (W1): 256 parts by mass.

Comparative Examples 5 to 7: Production of Toners (24) to (26)

Toners (24) to (26) were obtained in the same manner as in Example 5 except that the releasing agent particle dispersion (W1) was changed to releasing agent particle dispersions (W5) to (W7), respectively.

<Production of Developer>

A ferrite carrier which was coated with a silicone resin and had a volume average particle diameter of 40 μm was added to and mixed with each of the toners obtained in Examples and Comparative Examples above so as to have a toner particle concentration of 6% by mass, thereby preparing a developer, respectively.

TABLE 2-1

| | Amorphous polyester resin (A) | | | Vinyl resin (B) | | | | | | | | | Crystalline polyester resin (C) | | |
|---|---|---|---|---|---|---|---|---|---|---|---|---|---|---|---|
| | | | | | Monomer represented by General Formula (1) | | | | | | | | | | |
| Toner No. | Resin No. | Amount in toner [% by mass] | Amount in binder resin [% by mass] | Resin No. | $R^1$ | $R^2$ | n | Amount in vinyl resin [% by mass] | Weight average molecular weight | Acid value [mgKOH/g] | Amount in toner [% by mass] | Amount in binder resin [% by mass] | Resin No. | Amount in toner [% by mass] | Amount in binder resin [% by mass] |
| Example 1 | A1 | 70.0 | 80.5 | B1 | H | H | 10 | 0.5 | 80,000 | 10.0 | 9.0 | 10.3 | C1 | 8.0 | 9.2 |
| Example 2 | A1 | 70.0 | 80.5 | B2 | H | H | 8 | 0.5 | 80,000 | 10.0 | 9.0 | 10.3 | C1 | 8.0 | 9.2 |
| Example 3 | A1 | 70.0 | 80.5 | B3 | H | H | 10 | 0.5 | 80,000 | 1.0 | 9.0 | 10.3 | C1 | 8.0 | 9.2 |
| Example 4 | A1 | 70.0 | 80.5 | B4 | H | H | 10 | 0.5 | 80,000 | 30.0 | 9.0 | 10.3 | C1 | 8.0 | 9.2 |
| Example 5 | A1 | 70.0 | 80.5 | B5 | H | H | 12 | 0.5 | 80,000 | 10.0 | 9.0 | 10.3 | C1 | 8.0 | 9.2 |
| Example 6 | A1 | 70.0 | 80.5 | B5 | H | H | 12 | 0.5 | 80,000 | 10.0 | 9.0 | 10.3 | C1 | 8.0 | 9.2 |
| Example 7 | A1 | 70.0 | 80.5 | B5 | H | H | 12 | 0.5 | 80,000 | 10.0 | 9.0 | 10.3 | C1 | 8.0 | 9.2 |
| Example 8 | A1 | 70.0 | 80.5 | B5 | H | H | 12 | 0.5 | 80,000 | 10.0 | 9.0 | 10.3 | C1 | 8.0 | 9.2 |
| Example 9 | A1 | 70.0 | 80.5 | B6 | H | H | 18 | 0.5 | 80,000 | 10.0 | 9.0 | 10.3 | C1 | 8.0 | 9.2 |
| Example 10 | A1 | 70.0 | 80.5 | B7 | $CH_3$ | $CH_3$ | 10 | 0.5 | 80,000 | 10.0 | 9.0 | 10.3 | C1 | 8.0 | 9.2 |
| Example 11 | A1 | 70.0 | 80.5 | B8 | H | H | 12 | 0.5 | 25,000 | 35.0 | 9.0 | 10.3 | C1 | 8.0 | 9.2 |
| Example 12 | A1 | 70.0 | 80.5 | B9 | H | H | 12 | 0.5 | 30,000 | 10.0 | 9.0 | 10.3 | C1 | 8.0 | 9.2 |
| Example 13 | A1 | 70.0 | 80.5 | B10 | H | H | 12 | 0.5 | 200,000 | 10.0 | 9.0 | 10.3 | C1 | 8.0 | 9.2 |
| Example 14 | A1 | 70.0 | 80.5 | B11 | H | H | 12 | 0.5 | 220,000 | 0.2 | 9.0 | 10.3 | C1 | 8.0 | 9.2 |
| Example 15 | A1 | 70.0 | 80.5 | B12 | H | H | 28 | 0.5 | 80,000 | 10.0 | 9.0 | 10.3 | C1 | 8.0 | 9.2 |
| Example 16 | A1 | 70.0 | 80.5 | B15 | H | H | 12 | 0.1 | 50,000 | 10.0 | 9.0 | 10.3 | C1 | 8.0 | 9.2 |
| Example 17 | A1 | 70.0 | 80.5 | B16 | H | H | 12 | 5.0 | 150,000 | 10.0 | 9.0 | 10.3 | C1 | 8.0 | 9.2 |
| Example 18 | A1 | 59.0 | 67.8 | B5 | H | H | 12 | 0.5 | 80,000 | 10.0 | 20.0 | 23.0 | C1 | 8.0 | 9.2 |
| Example 19 | A1 | 76.0 | 87.4 | B5 | H | H | 12 | 0.5 | 80,000 | 10.0 | 3.0 | 3.4 | C1 | 8.0 | 9.2 |
| Comparative Example 1 | A1 | 20.0 | 23.0 | B5 | H | H | 12 | 0.5 | 80,000 | 10.0 | 59.0 | 67.8 | C1 | 8.0 | 9.2 |
| Comparative Example 2 | A1 | 70.0 | 80.5 | B13 | H | H | 2 | 0.5 | 80,000 | 10.0 | 9.0 | 10.3 | C1 | 8.0 | 9.2 |
| Comparative Example 3 | A1 | 70.0 | 80.5 | B14 | H | H | 40 | 0.5 | 80,000 | 10.0 | 9.0 | 10.3 | C1 | 8.0 | 9.2 |
| Comparative Example 4 | A1 | 79.0 | 90.8 | — | — | — | — | — | — | — | — | — | C1 | 8.0 | 9.2 |
| Comparative Example 5 | A1 | 70.0 | 80.5 | B5 | H | H | 12 | 0.5 | 80000 | 10.0 | 9.0 | 10.3 | C1 | 8.0 | 9.2 |
| Comparative Example 6 | A1 | 70.0 | 80.5 | B5 | H | H | 12 | 0.5 | 80000 | 10.0 | 9.0 | 10.3 | C1 | 8.0 | 9.2 |
| Comparative Example 7 | A1 | 70.0 | 80.5 | B5 | H | H | 12 | 0.5 | 80000 | 10.0 | 9.0 | 10.3 | C1 | 8.0 | 9.2 |

TABLE 2-2

| Toner No. | Releasing agent (W) | | | | | |
|---|---|---|---|---|---|---|
| | Releasing agent No. | Melting point [° C.] | Kind of wax | Acid value [mgKOH/g] | Amount in toner [% by mass] | Amount to 100 parts by mass of binder resin [parts by mass] |
| Example 1 | W1 | 74 | Ester wax | 0.1 | 8.0 | 9.2 |
| Example 2 | W1 | 74 | Ester wax | 0.1 | 8.0 | 9.2 |
| Example 3 | W1 | 74 | Ester wax | 0.1 | 8.0 | 9.2 |
| Example 4 | W1 | 74 | Ester wax | 0.1 | 8.0 | 9.2 |
| Example 5 | W1 | 74 | Ester wax | 0.1 | 8.0 | 9.2 |
| Example 6 | W2 | 67 | Ester wax | 0.1 | 8.0 | 9.2 |
| Example 7 | W3 | 84 | Ester wax | 0.1 | 8.0 | 9.2 |
| Example 8 | W4 | 71 | Ester wax | 2.4 | 8.0 | 9.2 |
| Example 9 | W1 | 74 | Ester wax | 0.1 | 8.0 | 9.2 |
| Example 10 | W1 | 74 | Ester wax | 0.1 | 8.0 | 9.2 |
| Example 11 | W1 | 74 | Ester wax | 0.1 | 8.0 | 9.2 |
| Example 12 | W1 | 74 | Ester wax | 0.1 | 8.0 | 9.2 |
| Example 13 | W1 | 74 | Ester wax | 0.1 | 8.0 | 9.2 |
| Example 14 | W1 | 74 | Ester wax | 0.1 | 8.0 | 9.2 |
| Example 15 | W1 | 74 | Ester wax | 0.1 | 8.0 | 9.2 |
| Example 16 | W1 | 74 | Ester wax | 0.1 | 8.0 | 9.2 |
| Example 17 | W1 | 74 | Ester wax | 0.1 | 8.0 | 9.2 |
| Example 18 | W1 | 74 | Ester wax | 0.1 | 8.0 | 9.2 |
| Example 19 | W1 | 74 | Ester wax | 0.1 | 8.0 | 9.2 |
| Comparative Example 1 | W1 | 74 | Ester wax | 0.1 | 8.0 | 9.2 |
| Comparative Example 2 | W1 | 74 | Ester wax | 0.1 | 8.0 | 9.2 |
| Comparative Example 3 | W1 | 74 | Ester wax | 0.1 | 8.0 | 9.2 |
| Comparative Example 4 | W1 | 74 | Ester wax | 0.1 | 8.0 | 9.2 |
| Comparative Example 5 | W5 | 63 | Ester wax | 10 | 8.0 | 9.2 |
| Comparative Example 6 | W6 | 95 | Ester wax | 101 | 8.0 | 9.2 |
| Comparative Example 7 | W7 | 75 | Hydrocarbon-based wax | 0 | 8.0 | 9.2 |

<Evaluation>

[Low Temperature Fixability]

In a copying machine "BIZHUB PRO C6501" (manufactured by Konica Minolta, Inc.), the fixing device was modified so as to be able to change the pressure in the nip area and the process speed (nip time) and further to change the surface temperature of the heat roller for fixing in a range of from 100 to 210° C. Each of the developers prepared from the respective toners was loaded in the copying machine.

A fixing experiment to output a solid image having a toner deposition amount of 8 g/m$^2$ on A4-sized thick paper "mondi Color Copy 350 g/m$^2$" (manufactured by Mondi) in an environment of normal temperature and normal humidity (temperature: 20° C. and relative humidity: 50% RH) was conducted by using each of the developers produced from the toners. At this time, the fixing experiment was repeatedly conducted while changing the fixing temperature to be set from 100 to 200° C. by 5° C. under the condition that the nip pressure of the fixing device was 238 kPa and the nip time was 25 msec (process speed: 480 mm/s).

The printed matter obtained in the fixing experiment at each fixing temperature was folded by using a folding machine so as to apply a load to the solid image, and the air compressed to 0.35 MPa was blown to the folded printed matter. The folded portion was ranked according to the following evaluation criteria.

Among the fixing experiments ranked 3 or higher, the fixing temperature in the fixing experiment by the lowest fixing temperature was taken as the lower limit fixing temperature. The low temperature fixability was evaluated by using this lower limit fixing temperature according to the following evaluation criteria, and those ranked 2 or higher were regarded to be acceptable. The evaluation results are presented in the following Table 3.

(Ranking Criteria of Fold)

5: Fold is not observed at all

4: Solid image is partially peeled off along fold

3: Solid image is peeled off along fold in fine linear form

2: Solid image is peeled off along fold in thick linear form

1: Solid image is greatly peeled off along fold.

(Evaluation Criteria of Fixing Temperature)

4: Lower limit fixing temperature is 120° C. or lower

3: Lower limit fixing temperature is higher than 120° C. and 125° C. or lower

2: Lower limit fixing temperature is higher than 125° C. and 130° C. or lower

1: Lower limit fixing temperature is higher than 130° C.

[Hot Offset Resistance]

Each of the developers produced from the respective toners was loaded in a copying machine modified in the same manner as the copying machine used for the evaluation of the [Low temperature fixability] described above.

A fixing experiment to output a solid image having a toner deposition amount of 8 g/m$^2$ on A4-sized plain paper "J paper (64 g/m$^2$)" (manufactured by Konica Minolta, Inc.) in an environment of normal temperature and normal humidity (temperature: 20° C. and relative humidity: 50% RH) was conducted by using each of the developers produced from the toners. At this time, the fixing experiment was repeatedly conducted while changing the fixing temperature to be set from 100 to 200° C. by 5° C. under the condition that the nip pressure of the fixing device was 238 kPa and the nip time was 25 msec (process speed: 480 mm/s).

The hot offset (H.O.) of the solid image was visually evaluated, and the hot offset resistance was evaluated according to the following evaluation criteria. Those ranked 2 or higher were regarded to be acceptable. The evaluation results are presented in the following Table 3.

(Evaluation Criteria)

4: Hot offset does not occur at 200° C. or lower.

3: Hot offset occurs at higher than 190° C. and 200° C. or lower.

2: Hot offset occurs at higher than 180° C. and 190° C. or lower.

1: Hot offset occurs at 180° C. or lower.

[Image Noise (Fog Density)]

Each of the developers produced from the respective toners was loaded in a copying machine "BIZHUB PRO C6501" (manufactured by Konica Minolta, Inc.).

The absolute image density of a blank sheet which had not been subjected to printing of the "CF paper (80 g/m$^2$)" (manufactured by Konica Minolta, Inc.) was first measured at 20 points by using the Macbeth reflection densitometer "RD-918" (manufactured by X-Rite Inc.), and the average value thereof was taken as the blank sheet density.

Next, printing to form a belt-like solid image having a coverage rate of 5% on A4-sized plain paper "CF paper (80 g/m$^2$)" (manufactured by Konica Minolta, Inc.) in a high humidity environment (temperature: 30° C. and relative humidity: 80% RH) was conducted 100,000 sheets. The absolute image density at the white background portion on the 100,000th solid image sheet was measured at 20 points in the same manner, the average value thereof was determined, and the value obtained by subtracting the blank sheet density from this average density was taken as the fog density. Fog density was evaluated according to the following evaluation criteria, and those ranked 2 or higher were regarded to be acceptable. The evaluation results are presented in the following Table 3.

(Evaluation Criteria)

4: Fog density is 0.002 or lower.

3: Fog density is higher than 0.002 and 0.005 or lower.

2: Fog density is higher than 0.005 and 0.010 or lower.

1: Fog density is higher than 0.010.

[Document Offset Resistance]

Each of the developers produced from the respective toners was loaded in a copying machine modified in the same manner as the copying machine used for the evaluation of the [Low temperature fixability] described above.

A solid image having a toner deposition amount of 8 g/m$^2$ on A4-sized plain paper "CF paper (80 g/m$^2$)" (manufactured by Konica Minolta, Inc.) was continuously printed 10 sheets in an environment of normal temperature and normal humidity (temperature: 20° C. and relative humidity: 50% RH) by using each of the developers produced from the toners. At this time, the nip pressure of the fixing device was set to 238 kPa, the nip time was set to 25 msec (process speed: 480 mm/s), and the fixing temperature was set to 150° C.

Subsequently, 10 sheets of the printed matter thus output were laminated and placed on a marble table as they were, and a weight was placed so that a pressure of 19.6 kPa (200 g/cm$^2$) was applied to the overlapped portion. The printed matter was allowed to stand in this state for 3 days in an environment at a temperature of 50° C. and a relative humidity of 50% RH, the laminated printed matter was then peeled off from one another, and the image defect on the toner image and the degree of set-off to the non-image portion of the back side of paper were evaluated as the document offset resistance according to the following criteria. Those ranked 3 or higher were regarded to be acceptable. The evaluation results are presented in the following Table 3.

(Evaluation Criteria)

5: Image defect or image migration is not observed on both image portion and non-image portion at all.

4: Image defect on image portion is not observed but slight image migration to non-image portion of back side of paper is observed.

3: Image defect on image portion is not almost observed to be in acceptable level but slight image migration to non-image portion of back side of paper is observed.

2: White spot of image defect is observed at places on image portion and image migration to non-image portion of back side of paper is observed at places.

1: Image defect is significant as fixed image at image portion is peeled off and clear image migration to non-image portion of back side of paper is observed.

TABLE 3

| | Low temperature fixability | | Hot offset resistance | | Image noise | |
|---|---|---|---|---|---|---|
| Toner No. | (Lower limit fixing temperature) | Rank | (H.O. occurring temperature) | Rank | (fog) Rank | Document offset resistance Rank |
| Example 1 | 120° C. | 4 | Higher than 200° C. | 4 | 4 | 5 |
| Example 2 | 120° C. | 4 | Higher than 200° C. | 4 | 2 | 4 |
| Example 3 | 120° C. | 4 | 195° C. | 3 | 3 | 5 |
| Example 4 | 120° C. | 4 | 195° C. | 3 | 3 | 5 |
| Example 5 | 120° C. | 4 | Higher than 200° C. | 4 | 4 | 5 |
| Example 6 | 115° C. | 4 | 195° C. | 3 | 4 | 4 |
| Example 7 | 125° C. | 3 | Higher than 200° C. | 4 | 4 | 3 |
| Example 8 | 120° C. | 4 | Higher than 200° C. | 4 | 4 | 3 |
| Example 9 | 120° C. | 4 | Higher than 200° C. | 4 | 3 | 4 |
| Example 10 | 120° C. | 4 | Higher than 200° C. | 4 | 3 | 5 |
| Example 11 | 120° C. | 4 | 185° C. | 2 | 2 | 4 |
| Example 12 | 120° C. | 4 | 195° C. | 3 | 4 | 5 |
| Example 13 | 130° C. | 2 | Higher than 200° C. | 4 | 4 | 4 |
| Example 14 | 130° C. | 2 | 200° C. | 3 | 2 | 4 |
| Example 15 | 120° C. | 4 | 195° C. | 3 | 2 | 3 |
| Example 16 | 120° C. | 4 | 190° C. | 2 | 2 | 3 |
| Example 17 | 130° C. | 2 | Higher than 200° C. | 4 | 4 | 5 |
| Example 18 | 130° C. | 2 | Higher than 200° C. | 4 | 4 | 4 |
| Example 19 | 120° C. | 4 | 185° C. | 2 | 2 | 3 |

TABLE 3-continued

| Toner No. | Low temperature fixability (Lower limit fixing temperature) | Rank | Hot offset resistance (H.O. occurring temperature) | Rank | Image noise (fog) Rank | Document offset resistance Rank |
|---|---|---|---|---|---|---|
| Comparative Example 1 | 150° C. | 1 | Higher than 200° C. | 4 | 3 | 1 |
| Comparative Example 2 | 120° C. | 4 | Higher than 200° C. | 4 | 1 | 2 |
| Comparative Example 3 | 120° C. | 4 | 190° C. | 2 | 1 | 2 |
| Comparative Example 4 | 120° C. | 4 | 150° C. | 1 | 1 | 3 |
| Comparative Example 5 | 120° C. | 4 | 160° C. | 1 | 1 | 2 |
| Comparative Example 6 | 140° C. | 1 | Higher than 200° C. | 4 | 3 | 2 |
| Comparative Example 7 | 120° C. | 4 | 190° C. | 2 | 1 | 5 |

From the results in Table 3, it has been indicated that it is possible to suppress image noise (fog) while favorably maintaining the low temperature fixability and the hot offset resistance and excellent document offset resistance is obtained in the case of using the toner according to the present invention.

On the other hand, in the toners (Comparative Examples 2 to 4) which do not contain the vinyl resin containing the monomer represented by General Formula (1) according to the present invention but contains an ester wax, favorable results have not been obtained as image noise (fog) occurs and the like. In addition, from the results of Comparative Examples 5 to 6, it has been indicated that the melting point of the ester wax also greatly affects the effect of the present invention.

Japanese Patent Application No. 2016-184774 filed on Sep. 21, 2016 including description, claims, and abstract the entire disclosure is incorporated herein by reference in its entirety.

What is claimed is:

1. A toner for electrostatic charge image development comprising:

a binder resin and a releasing agent, wherein the binder resin comprises an amorphous polyester resin as a main component and a vinyl resin, wherein the vinyl resin comprises a constitutional unit derived from a monomer represented by the following General Formula (1), and the releasing agent has a melting point of from 65 to 90° C. and comprises an ester wax:

General Formula (1)

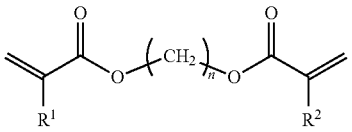

in the General Formula (1), $R^1$ and $R^2$ each independently represent a hydrogen atom or a methyl group and n is an integer from 8 to 30.

2. The toner for electrostatic charge image development according to claim 1, wherein the releasing agent has a melting point of from 70 to 80° C.

3. The toner for electrostatic charge image development according to claim 1, wherein the releasing agent has an acid value of 1 mg KOH/g or less.

4. The toner for electrostatic charge image development according to claim 1, wherein an amount of the constitutional unit derived from a monomer represented by the General Formula (1) in the vinyl resin is from 0.1 to 5.0% by mass.

5. The toner for electrostatic charge image development according to claim 1, wherein n in the General Formula (1) is an integer from 10 to 18.

6. The toner for electrostatic charge image development according to claim 1, wherein a weight average molecular weight of the vinyl resin is from 30,000 to 200,000.

7. The toner for electrostatic charge image development according to claim 1, wherein an amount of the vinyl resin in the binder resin is from 3 to 20% by mass.

8. The toner for electrostatic charge image development according to claim 1, wherein the vinyl resin has an acid value of from 1 to 30 mg KOH/g.

9. The toner for electrostatic charge image development according to claim 1, wherein the binder resin comprises a crystalline resin.

10. The toner for electrostatic charge image development according to claim 1, wherein the releasing agent comprises at least one selected from the group consisting of behenyl behenate, stearyl stearate, behenyl stearate, stearyl behenate, and pentaerythritol tetrabehenate.

11. The toner for electrostatic charge image development according to claim 1, wherein the releasing agent comprises at least one selected from the group consisting of behenyl behenate, stearyl stearate, behenyl stearate, and stearyl behenate.

12. The toner for electrostatic charge image development according to claim 1, wherein an amount of the releasing agent is from 5 to 15 parts by mass relative to 100 parts by mass of the binder resin.

13. The toner for electrostatic charge image development according to claim 1, wherein an amount of the ester wax in the releasing agent is 50% by mass or more relative to a total amount of the releasing agent.

14. The toner for electrostatic charge image development according to claim 1, wherein the releasing agent consists of the ester wax.

* * * * *